US010053194B1

(12) United States Patent
Majewski et al.

(10) Patent No.: US 10,053,194 B1
(45) Date of Patent: Aug. 21, 2018

(54) MINIATURE SONOBUOY ADAPTER KIT WITH PNEUMATIC AIR DIVERTER VALVE

(71) Applicant: Harris Corporation, Melbourne, FL (US)

(72) Inventors: Kenneth Majewski, Commack, NY (US); Thomas Lithen, Lynbrook, NY (US); Xiaochun Fisher, East Setauket, NY (US); Robert Eschbach, East Rockaway, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 15/495,023

(22) Filed: Apr. 24, 2017

(51) Int. Cl.
*B63B 22/00* (2006.01)
*B64D 1/08* (2006.01)

(52) U.S. Cl.
CPC ..... *B63B 22/003* (2013.01); *B64D 1/08* (2013.01); *B63B 2022/006* (2013.01)

(58) Field of Classification Search
CPC .... B63B 22/003; B63B 2022/006; B64D 1/08
USPC ..... 124/56
See application file for complete search history.

(56) References Cited

U.S. PATENT DOCUMENTS 3,240,200 A * 3/1966 Jones ..... B64D 1/02 124/75
3,724,374 A * 4/1973 Somerville ..... G10K 11/006 102/417
3,905,291 A * 9/1975 Corbin, Jr. ..... F42B 3/04 102/430
3,921,120 A * 11/1975 Widenhofer ..... B63B 22/003 116/209
5,052,270 A * 10/1991 Travor ..... B63B 22/003 244/137.4
5,054,364 A * 10/1991 Dragonuk ..... B63B 22/003 244/137.1
5,063,823 A * 11/1991 Marshall ..... B63B 22/003 244/137.1

(Continued)

OTHER PUBLICATIONS

U.S. Statutory Invention Registration No. H1025, Dragonuk, et al., published Mar. 3, 1992.

*Primary Examiner* — Joshua E Freeman
(74) *Attorney, Agent, or Firm* — Edell, Shapiro & Finnan, LLC

(57) ABSTRACT

The present invention is directed toward an adapter for launching miniature sonobuoys from a standard sized sonobuoy launching container. The adapter includes a first cylindrical member, a second cylindrical member, and a diverter member, and is disposed within the container. The first member includes a central passage that retains a first miniature sonobuoy. The second member includes a central passage retains a second miniature sonobuoy. The second member further includes at least one channel that extends through the sidewall of the second member. The diverter member is in fluid communication with the at least one channel and the central passage of the second member. The diverter is configured to divert a first burst of air along the at least one channel to launch the first miniature sonobuoy and divert a second burst of air along the central passage of the second cylindrical member to launch the second miniature sonobuoy.

20 Claims, 24 Drawing Sheets

(56) References Cited

U.S. PATENT DOCUMENTS

| | | | | | |
|---|---|---|---|---|---|
| 5,070,760 | A | * | 12/1991 | Marshall | B64D 1/04 244/137.4 |
| 5,076,134 | A | * | 12/1991 | Marshall | B64D 1/04 244/137.4 |
| H001025 | H | * | 3/1992 | Dragonu | 89/1.51 |
| 5,155,288 | A | * | 10/1992 | Marshall | B63B 22/003 89/1.51 |
| 5,379,267 | A | * | 1/1995 | Sparks | B63B 22/18 367/18 |
| 5,623,113 | A | * | 4/1997 | Valembois | F41H 9/08 102/340 |
| 5,973,994 | A | * | 10/1999 | Woodall | F42B 15/22 367/3 |
| 7,278,416 | B2 | | 10/2007 | Larcheveque et al. | |

* cited by examiner

MINIATURE SONOBUOY ADAPTER KIT WITH PNEUMATIC AIR DIVERTER VALVE

BACKGROUND OF THE INVENTION

Sonobuoys are relatively small buoys (i.e., floating devices) equipped with expendable sonar systems that are dropped or ejected from aircraft or ships for the purpose of conducting anti-submarine warfare or underwater acoustic research. Typically, sonobuoys are stored, transported, and launched pneumatically from an aircraft with one sonobuoy per sonobuoy launching container (hereinafter "SLC"). Recent advances in the sonobuoy technology area have resulted in the creation of a new miniature sonobuoy. These miniature sonobuoys contain all of the same features as a conventional "A-sized" sonobuoy, but are nearly half the size of the conventional A-sized sonobuoys. The miniature sonobuoys enable an aircraft to double the number of sonobuoys that can be carried, which doubles an aircraft's mission capabilities. However, aircraft that are currently in use in the industry are equipped only with A-size sonobuoy SLCs. Because of their reduced size, there is currently no method for pneumatically launching two miniature sonobuoys from a standard A-size sonobuoy SLC without drastically altering the A-size sonobuoy launcher or installing new sonobuoy launchers, both of which are expensive.

Accordingly, it would be desirable to provide an adapter kit that provides the capability of launching two miniature sonobuoys independently from a standard A-sized SLC without altering the SLC. Additionally, it would be desirable to maximize the life cycle cost of the adapter kit by utilizing the pneumatic launching system of the SLC without requiring electrical systems, hydraulic systems, or other complicated mechanical systems. Furthermore, it would be desirable to automatically sequence the air from the pneumatic launching system of the SLC to independently launch each miniature sonobuoy from the SLC without requiring manual reconfiguration of the adapter kit. Finally, it would be desirable to have an adapter kit that is capable of being reloaded with miniature sonobuoys and reused for subsequent launchings of miniature sonobuoys.

SUMMARY OF THE INVENTION

The present disclosure is directed toward an adapter for launching miniature sonobuoys from a standard sized sonobuoy launching container. The adapter includes a first cylindrical member, a second cylindrical member, and a diverter mechanism. The first cylindrical member is disposed within the sonobuoy launching container and includes a first end, a second end, and a first central passage that extends from the second end to the first end. The second cylindrical member is disposed within the sonobuoy launching container in line with the first cylindrical member. The second cylindrical member includes a third end, a fourth end, a sidewall that extends from the fourth end to the third end, at least one channel disposed within the sidewall, and a second central passage that extends from the fourth end to the third end. The third end of the second cylindrical member is in abutment with the second end of the first cylindrical member. Furthermore, the first central passage is in fluid communication with the second central passage. The diverter mechanism is disposed within the sonobuoy launching container in line with the first cylindrical member and the second cylindrical member. The diverter mechanism is configured to automatically divert a first burst of air along the at least one channel of the second cylindrical member and automatically divert a subsequent second burst of air along the second central passage of the second cylindrical member in order to independently launch two miniature sonobuoys.

The present disclosure is further directed to a diverter mechanism that includes a base, a piston, and a rotary disc. The base includes a top side, a bottom side, and a central cavity disposed within the top side. The base also includes at least one inner opening disposed within the central cavity and extending through the bottom side of the base, and at least one outer opening disposed in the base and in fluid communication with the central cavity, the at least one outer opening also extending through the bottom side of the base. The piston of the diverter mechanism includes a top side, a bottom side, a circular cavity, and at least one air port. The piston is slidably disposed within the central cavity of the base between a first position, where the piston covers the at least one outer opening and the bottom side of the piston is spaced from the at least one inner opening, and a second position, where the at least one outer opening is exposed and the bottom side of the piston is disposed proximate to the at least one inner opening. The circular cavity is concentrically disposed within the top side of the piston, and the least one air port is disposed within the circular cavity such that the at least one air port extends through the bottom side of the piston. The rotary disc is rotatably disposed within the central cavity of the piston and includes at least one aperture. The rotary disc is rotatable between a locked position, where the at least one aperture is not aligned with the at least one air port of the piston, and an unlocked position, where the at least one aperture is aligned with the at least one air port of the piston. When the rotary disc is in the locked position and the pneumatic diverter mechanism receives a first burst of air, the piston is reconfigured from the first position to the second position causing the first burst of air to be diverted through the at least one outer opening and causing the rotary disc to automatically rotate to the unlocked position. When the rotary disc is in the unlocked position and the pneumatic diverter mechanism receives a second burst of air, the second burst of air is diverted through the at least one air port of the piston and the at least one inner opening of the base.

In addition, the present disclosure is also directed to a pneumatic diverter mechanism that includes a base, a piston, and a burst disc. The base includes a top side, a bottom side, a central cavity disposed within the top side, at least one inner opening, at least one outer opening, and at least one projection. The at least one inner opening is disposed within the central cavity and extends through to the bottom side of the base. The at least one outer opening is disposed in the base and in fluid communication with the central cavity, where the at least one outer opening also extends through to the bottom side of the base. The at least one projection extends upward through the central cavity of the base. The piston includes a top side, a bottom side, a circular cavity, and a central opening. The piston is slidably disposed within the central cavity of the base between a first position and a second position. The circular cavity is concentrically disposed within the top side of the piston. The central opening is disposed within the circular cavity and extends through to the bottom side of the piston. When the piston is in the first position, the piston covers the at least one outer opening and the bottom side of the piston is spaced from the at least one inner opening and the at least one projection. When the piston is in the second position, the at least one outer opening is exposed, the bottom side of the piston is disposed proximate to the at least one inner opening, and the at least one projection extends through the central opening. The burst disc is disposed within the central cavity of the piston such that the burst disc forms a seal over the central opening of the piston. When the pneumatic diverter mechanism receives a first burst of air, the piston is reconfigured from the first position to the second position causing the first burst of air to be diverted through the at least one outer opening and causing the at least one projection to puncture the burst disc. When the pneumatic diverter mechanism receives a subsequent second burst of air, the second burst of air is diverted through the punctured burst disc and the at least one inner opening of the base.

BRIEF DESCRIPTION OF THE DRAWINGS

Like reference numerals have been used to identify like elements throughout this disclosure.

DETAILED DESCRIPTION OF THE INVENTION

Figure 1:
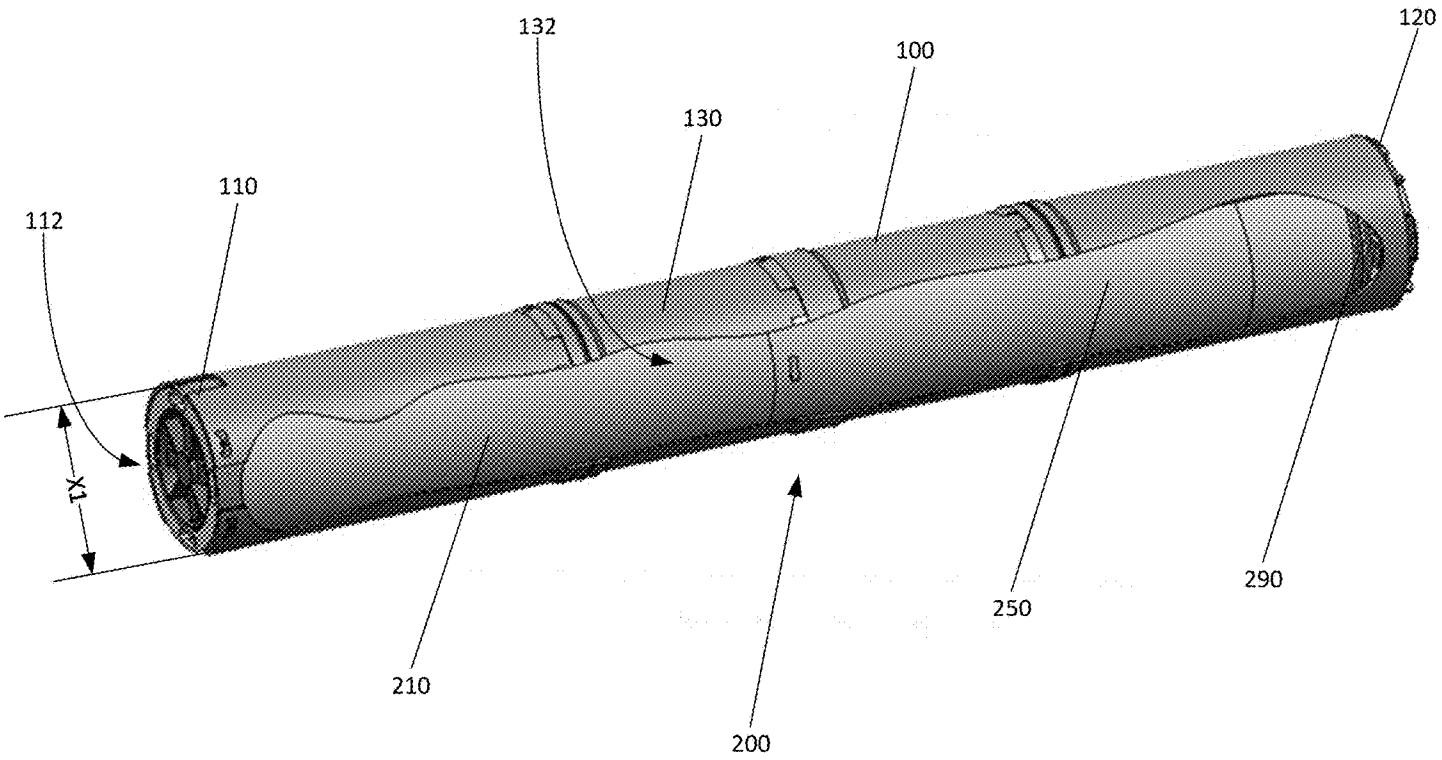
FIG. 1 illustrates a perspective view of a standard sonobuoy launching container equipped with a miniature sonobuoy adapter kit according to the present disclosure.
Figure 10:
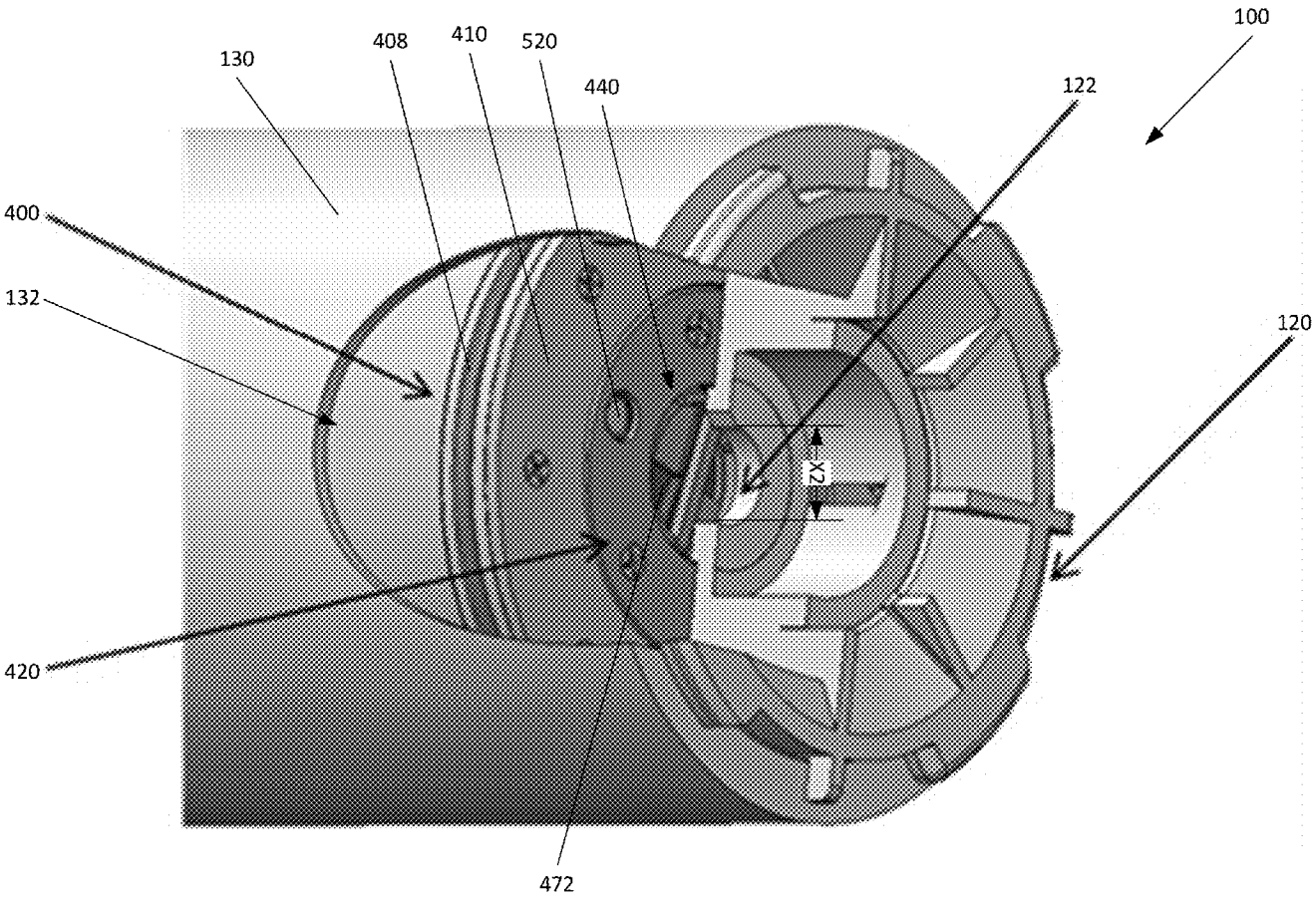
FIG. 10 illustrates a perspective view of the first embodiment of the pneumatic air diverter valve illustrated in FIG. 4 disposed within the standard sonobuoy launching container illustrated in FIG. 1.
Figure 16:
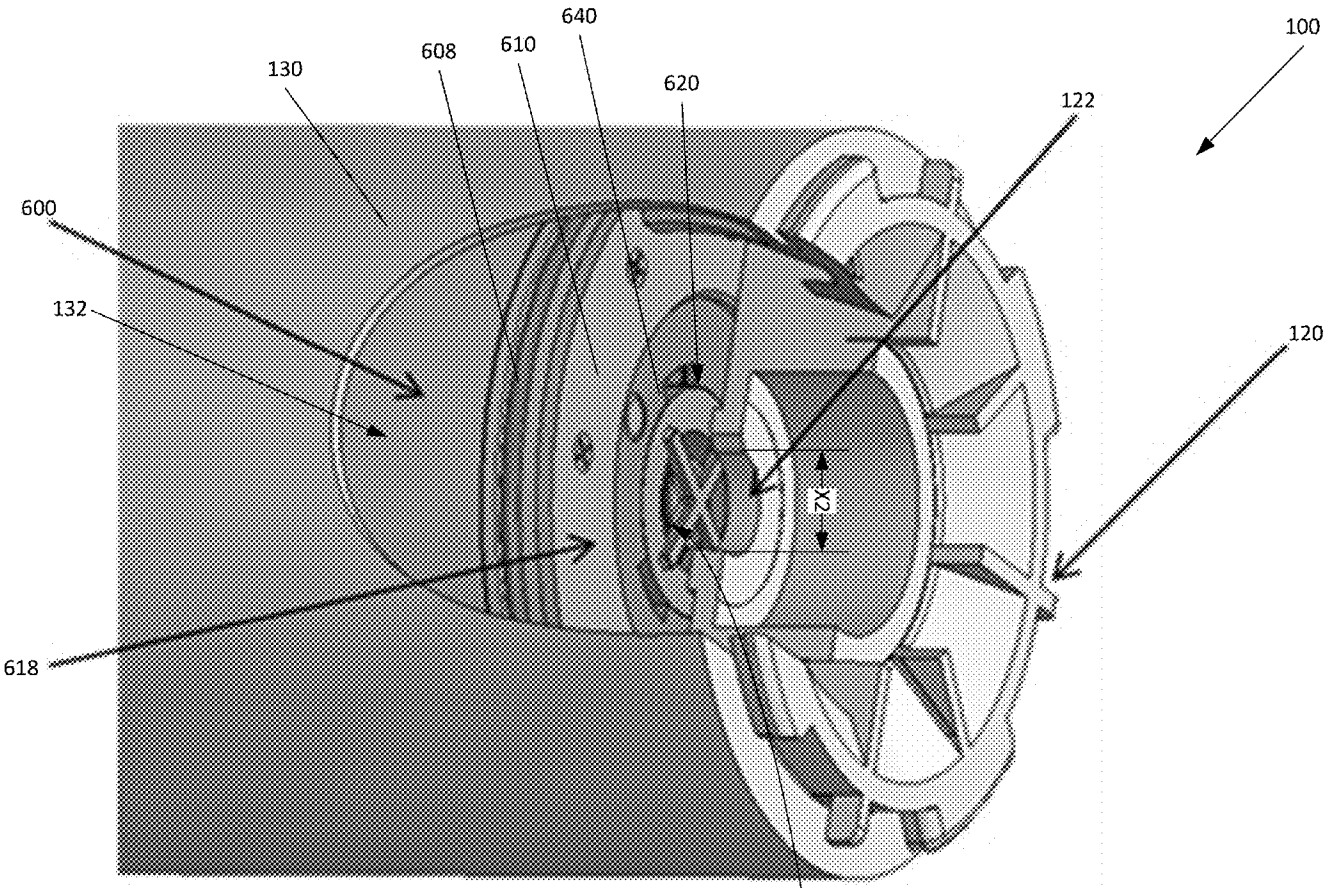
FIG. 16 illustrates a perspective view of the second embodiment of the pneumatic air diverter valve illustrated in FIG. 12 disposed within the standard sonobuoy launching container illustrated in FIG. 1.

Illustrated in FIG. 1 is a conventional A-size sonobuoy launching container 100 (hereinafter "SLC") with a miniature sonobuoy adapter kit 200 disposed within the SLC 100. As illustrated, the SLC 100 is substantially cylindrical with a first end 110, an opposite second end 120, and a sidewall 130 spanning between the first and second ends 110, 120. The first end 110 of the SLC 100 includes a substantially circular opening 112 with a diameter of X1, while, as best illustrated in FIGS. 10 and 16, the second end 120 of the SLC 100 includes a substantially circular aperture 122 with a diameter of X2. The diameter X1 of the opening 112 is larger than the diameter X2 of the aperture 122. Moreover, the first end 110, the second end 120, and the sidewall 130 collectively define a cavity 132. FIG. 1 illustrates the sidewall 130 of the SLC 100 with a cutaway section for illustrative purposes only.

Figure 2:
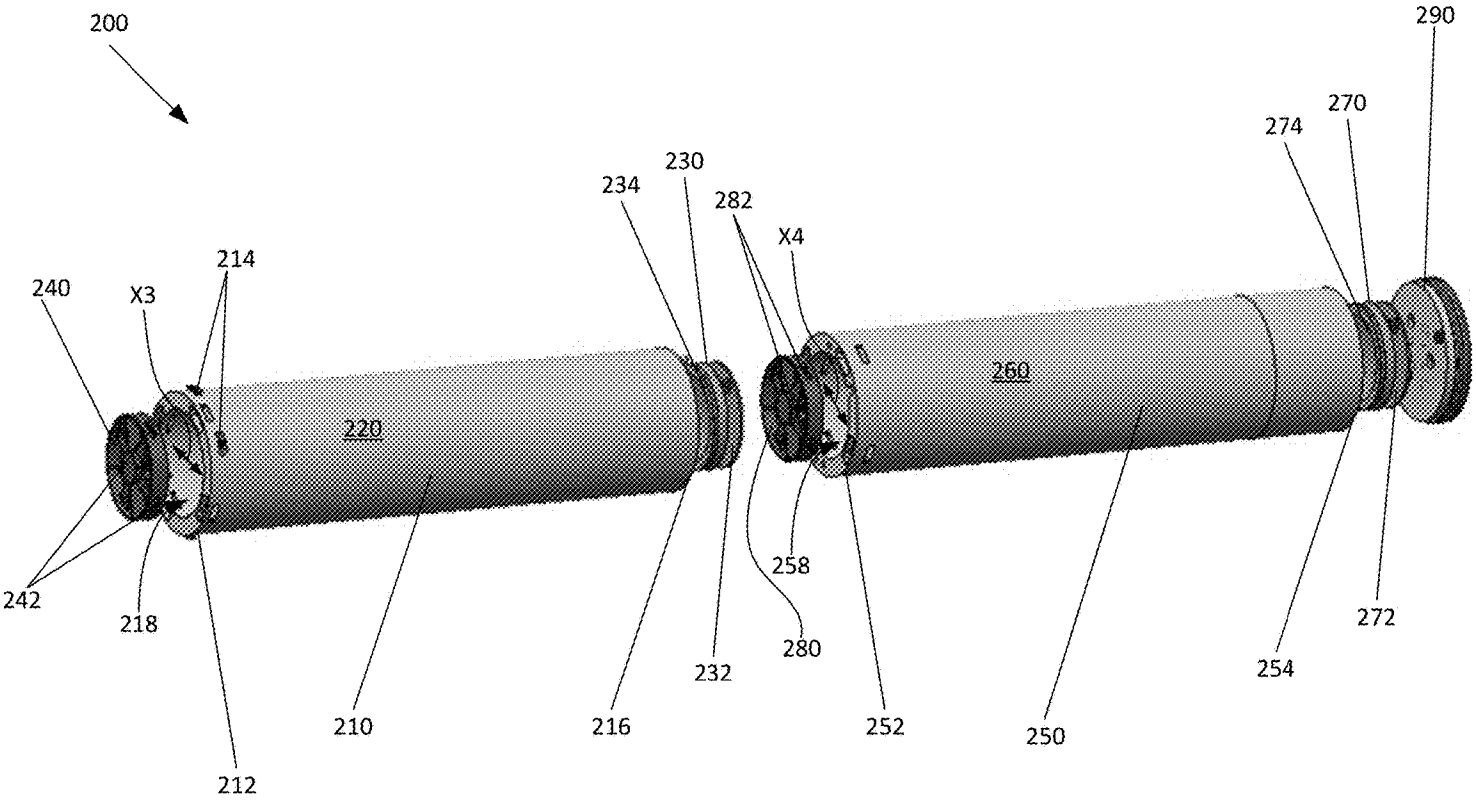
FIG. 2 illustrates an exploded view of the miniature sonobuoy adapter kit according to the present disclosure.

As illustrated in FIG. 1, the adapter kit 200 is disposed within the cavity 132 of the SLC 100. As illustrated in FIGS. 1 and 2, the adapter kit 200 comprises a first, or lower, adapter member 210, a second, or upper, adapter member 250, and a diverter valve or mechanism 290. The first adapter member 210, second adapter member 250, and the diverter mechanism 290 are disposed in-line with one another within the cavity 132 of the SLC 100. As further illustrated, the first adapter member 210 is disposed proximate to the first end 110 and the opening 112 of the SLC 100, while the diverter mechanism 290 is disposed proximate to the second end 120 and the aperture 122 of the SLC 100. The second adapter member 250 is disposed between the first adapter member 210 and the diverter mechanism 290.

Figure 3A:
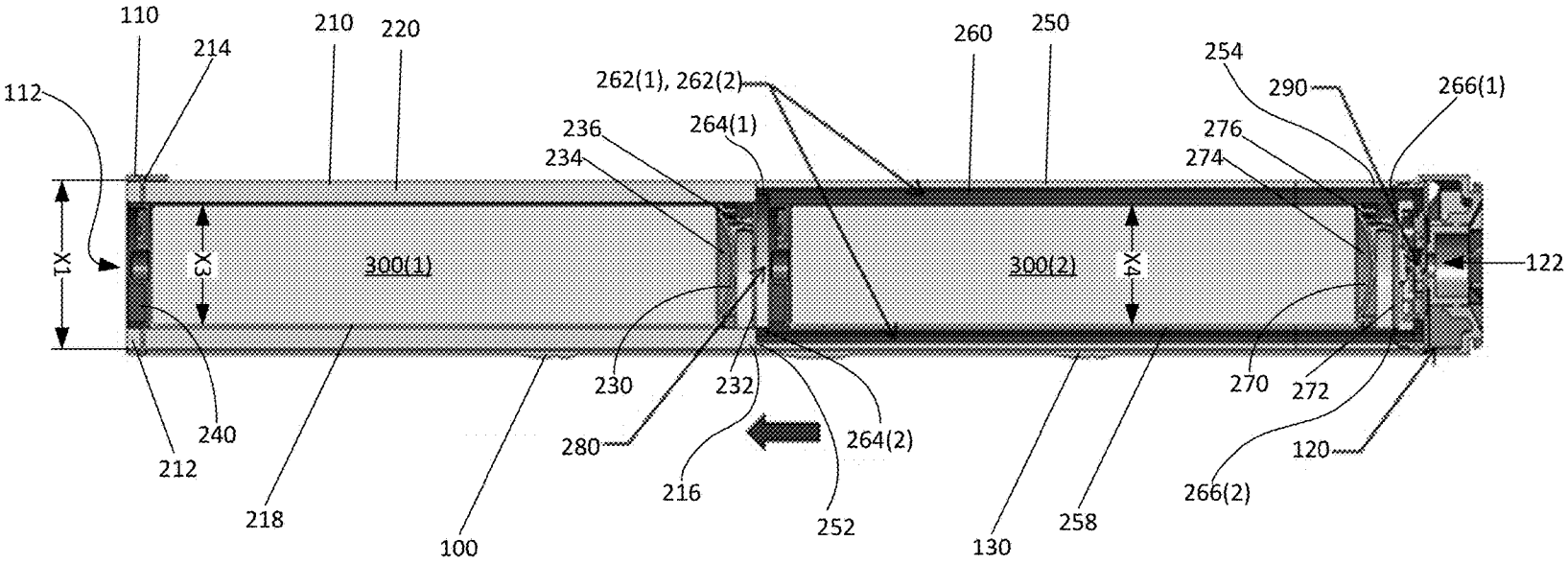
FIGS. 3A-3D illustrate cross-sectional views of the launching stages for launching two miniature sonobuoys from the miniature sonobuoy adapter kit disposed within a standard sonobuoy launching container, as illustrated in FIG. 1.

Aircraft may be equipped with multiple SLC's 100 configured to deploy or launch sonobuoys from the SLC's 100. As shown in FIG. 3A, the adapter kit 200 disclosed enables the standard sized SLC's 100 to be loaded with two miniature sonobuoys 300(1), 300(2) without requiring the SLC's to be altered or reconfigured. As described herein, the adapter kit 200 enables an SLC 100 to independently launch each one of the two miniature sonobuoys 300(1), 300(2) from the SLC 100 via a pneumatic launching mechanism.

Continuing with the exploded view of the adapter kit 200 illustrated in FIG. 2, the first adapter member 210 is a substantially cylindrical tube with a first end 212, an opposite second end 216, and a sidewall 220 connecting the first and second ends 212, 216 of the first adapter member 210. The first adapter member 210 further includes a central passage 218 that extends through the first adapter member 210 from the first end 212 to the second end 216. The central passage 218 has an interior diameter of X3, which is smaller than the diameter X1 of the opening 112 of the SLC 100, but may be larger than the diameter X2 of the aperture 122 of the SLC 100. The first adapter member 210 is sized and shaped to fit within the cavity 132 of the SLC 100 proximate to the first end 110 of the SLC, while being configured to accept a first miniature sonobuoy 300(1) within the central passage 218.

The first adapter member 210 further includes a piston 230 and an endcap 240. As illustrated in FIG. 3A, both the piston 230 and the endcap 240 are sized and shaped to fit within the central passage 218. The piston 230 and the endcap 240 may both be substantially disc-shaped with diameters substantially equal to the diameter X3 of the central passage 218. As illustrated, the endcap 240 is disposed within the central passage 218 proximate to the first end 212 of the first adapter member 210, while the piston 230 is disposed within the central passage 218 proximate to the second end 216 of the first adapter member 210. In addition, a first miniature sonobuoy 300(1) is disposed within the central passage 218 between the endcap 240 and the piston 230. As best illustrated in FIG. 2, the endcap 240 may include a series of shear clips 242 disposed around the perimeter or periphery of the endcap 240, where the shear clips 242 interact with the central passage 218 to temporarily retain the endcap 240 within the first end 212 of the first adapter member 210. In addition, the piston 230 may include a first, or upper, disc member 232, a second, or lower, disc member 234, and a series of support members 236 coupling the first disc member 232 to the second disc member 234. Thus, the support members 236 space the first disc member 232 from the second disc member 234.

Similar to the first adapter member 210, the second adapter member 250 is also a substantially cylindrical tube with a first end 252, an opposite second end 254, and a sidewall 260 connecting the first and second ends 252, 254 of the second adapter member 250. Furthermore, the second adapter member 210 includes a central passage 258 that extends through the second adapter member 250 from the first end 252 to the second end 254. The central passage 258 has an interior diameter of X4, which is substantially equal to that of the interior diameter X3 of the central passage 218 of the first adapter member 210. Thus, the diameter X4 of the central passage 258 is smaller than the diameter X1 of the opening 112 of the SLC 100, but may be larger than the diameter X2 of the aperture 122 of the SLC 100. Also similar to the first adapter member 210, the second adapter member 250 is sized and shaped to fit within the cavity 132 of the SLC 100. As illustrated in FIG. 3A, when disposed within the cavity 132 of the SLC 100, the first end 252 of the second adapter member 250 is in abutment with the second end 216 of the first adapter member 210. Furthermore, the diverter mechanism 290, which is disposed within the cavity 132 of the SLC 100 proximate to the second end 120 of the SLC 100, is in abutment with the second end 254 of the second adapter member 250.

Like the first adapter member 210, the second adapter member 250 also includes a piston 270 and an endcap 280. As illustrated in FIG. 3A, both the piston 270 and the endcap 280 are sized and shaped to fit within the central passage 258 of the second adapter member 250. The piston 270 and the endcap 280 may both be substantially disc-shaped with diameters substantially equal to the diameter X4 of the central passage 258 of the second adapter member 250. The piston 270 and the endcap 280 of the second adapter kit 250 are identical to the piston 230 and the endcap 240 of the first adapter kit 210. When the second adapter kit 250 is disposed within the cavity 132 of the SLC 100, the endcap 280 is disposed within the central passage 258 proximate to the first end 252 of the second adapter member 250, while the piston 270 is disposed within the central passage 258 proximate to the second end 254 of the second adapter member 250. As illustrated in FIG. 3A, a second miniature sonobuoy 300(2) is disposed within the central passage 258 of the second adapter member 250 between the endcap 280 and the piston 270. Like endcap 240, and as best illustrated in FIG. 2, the endcap 280 may include a series of shear clips 282 disposed around the perimeter or periphery of the endcap 280, where the shear clips 282 interact with the central passage 258 of the second adapter member 250 to temporarily retain the endcap 280 within the first end 252 of the second adapter member 250. In addition, the piston 270 may include a first, or upper, disc member 272, a second, or lower, disc member 274, and a series of support members 276 coupling the first disc member 272 to the second disc member 274, like that of piston 230.

The second adapter member 250, however, differs from the first adapter member 210 in that the second adapter member 250 includes two channels 262(1), 262(2) disposed within the sidewall 260 of the second adapter member 250. First channel 262(1) includes a distal end 264(1) disposed proximate to the first end 252 of the second adapter member 250, and a proximal end 266(1) disposed proximate to the second end 254 of the second adapter member 250. Thus, first channel 262(1) spans nearly the entire length of the second adapter member 250 through the sidewall 260 of the second adapter member 250. Similarly, second channel 262(2) includes a distal end 264(2) disposed proximate to the first end 252 of the second adapter member 250, and a proximal end 266(2) disposed proximate to the second end 254 of the second adapter member 250. Thus, second channel 262(2) spans nearly the entire length of the second adapter member 250 through the sidewall 260 of the second adapter member 250. As best illustrated in FIG. 3A, the first and second channels 262(1), 262(2) are disposed within the sidewall 260 such that the first and second channels 262(1), 262(2) are oriented opposite of one another (i.e., they are spaced circumferentially around the sidewall 260 approximately 180 degrees from one another). The proximal ends 266(1), 266(2) of the channels 262(1), 262(2) serve as the inlets of the channels 262(1), 262(2), where the proximal ends 266(1), 266(2) are in fluid communication with the diverter mechanism 290. Thus, as explained in further detail below, the proximal ends 266(1), 266(2) of the channels 262(1), 262(2) receive air that travels through the diverter mechanism 290 such that air travels along the channels 262(1), 262(2). Moreover, the distal ends 264(1), 264(2) of the channels 262(1), 262(2) serve as outlets of the channels 262(1), 262(2), where the distal ends 264(1), 264(2) are in fluid communication with the space disposed between the endcap 280 of the second adapter member 250 and the piston 230 of the first adapter member 210. Thus, air that is diverted into the proximal ends 266(1), 266(2) of the channels 262(1), 262(2) by the diverter mechanism 290 travels along the channels 262(1), 262(2) to the distal ends 264(1), 264(2) of the channels 262(1), 262(2) and into the space between the endcap 280 of the second adapter member 250 and the piston 230 of the first adapter member 210.

As previously explained, the diverter mechanism 290 is disposed within the cavity 132 of the SLC 100 proximate to the second end 120 and the aperture 122 of the SLC 100. As will be further detailed below, the diverter mechanism 290 is capable of receiving a series of air bursts via a pneumatic launching mechanism (not shown) through the aperture 122 of the second end 120 of the SLC 100. The diverter mechanism 290 is configured to divert a first burst of air from the pneumatic launching mechanism along the channels 262(1), 262(2), while diverting a second burst of air from the pneumatic launching mechanism along the central passage 258 of the second adapter member 250.

Continuing with FIGS. 2 and 3A, disposed on the exterior of the sidewall 220 of the first adapter member are a series of fasteners 214 that interact with the sidewall 130 of the SLC 100 proximate to the first end 110 and the opening 112 of the SLC to retain the first adapter member 210 within the cavity 132 of the SLC 100. In one embodiment, the fasteners 214 may be shear clips that retain the first adapter member 210 within the cavity 132 of the SLC 100, while, in another embodiment, the fasteners 214 may be screws or bolts that retain the first adapter member 210 within the cavity 132 of the SLC 100. Because the first adapter member 210 is disposed more proximate to the opening 112 of the first end 110 of the SLC 100 than the second adapter member 250 and the diverter mechanism 290, and because the first adapter member 210, second adapter member 250, and diverter mechanism 290 are greater in size than the diameter X2 of the aperture 122 of the second end 120 of the SLC 100, the fasteners 214 retain not just the first adapter member 210 within the cavity 132 of the SLC 100, but also the second adapter member 250 and the diverter mechanism 290.

FIGS. 3A-3D illustrate the launching stages of the miniature sonobuoys from the SLC 100 via the adapter kit 200. As previously explained, and as illustrated in FIG. 3A, prior to launching one of the miniature sonobuoys 300(1), 300(2) from the SLC 100, the first miniature sonobuoy 300(1) is disposed within the central passage 218 of the first adapter 210 of the adapter kit 200, while the second miniature sonobuoy 300(2) is disposed within the central passage 258 of the second adapter 250 of the adapter kit 200. The fasteners 214 of the first adapter member 210 retain the adapter members 210, 250 and the diverter mechanism 290 within the cavity 132 of the SLC 100, while the endcap 240 retains the first miniature sonobuoy 300(1) within the first adapter member 210, and the endcap 280 retains the second miniature sonobuoy 300(2) within the second adapter member 250. When launched, the sonobuoys 300(1), 300(2) are expelled out from the first end 110 of the SLC 100 via the opening 112.

Figure 3B:
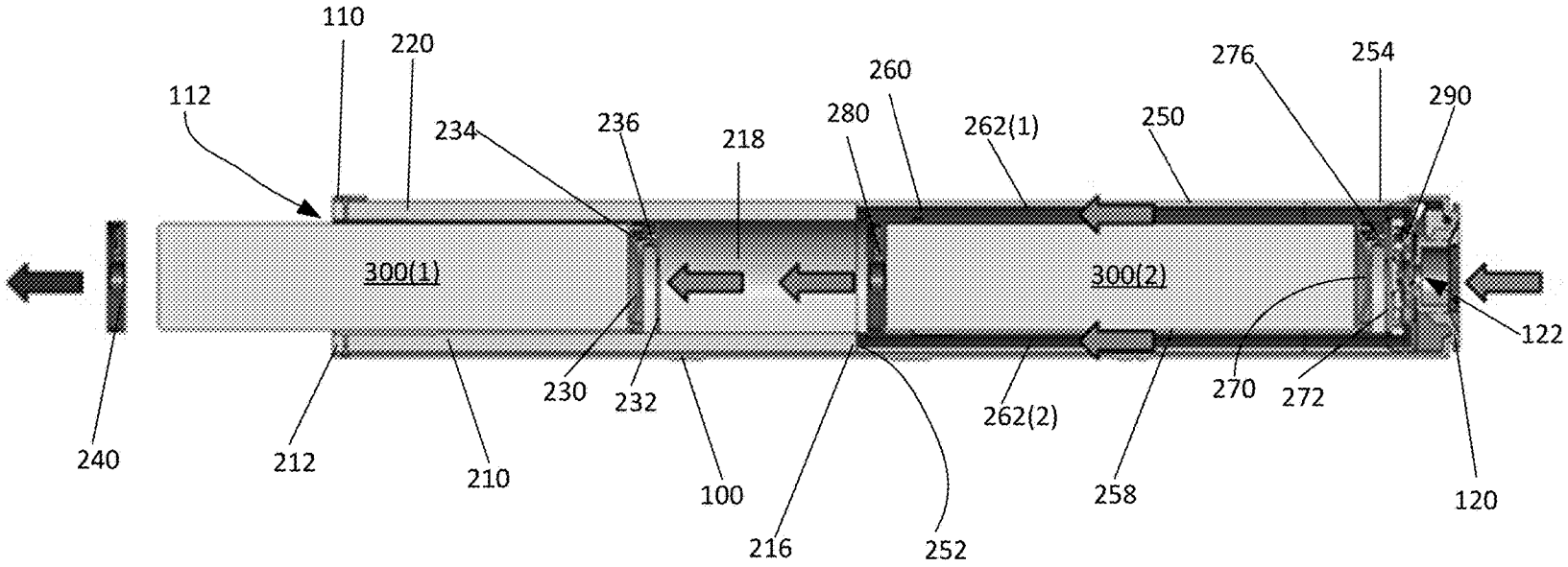

As illustrated in FIG. 3B, when the SLC 100 receives the first burst of air from the pneumatic launching mechanism, the air travels into the diverter mechanism 290 via the aperture 122 on the second end 120 of the SLC 100. The diverter mechanism 290 is initially set to divert the received first burst of air along the channels 262(1), 262(2) and into the space between the endcap 280 of the second adapter member 250 and the piston 230 of the first adapter member 210. The first burst of air is configured to act on the first disc member 232 of the piston 230, causing the first disc member 232 to slightly deform (i.e., become concave). Because the first disc member 232 is spaced from the second disc member 234 via the support members 236, the first disc member 232 is free to deform when the pressure or force of the air burst is applied to the first disc member 232. The deformation of the first disc member 232 of the piston 230 at least partially forms a seal with the interior surface of the sidewall 220 that forms the central passage 218. The force or pressure from the first burst of air causes the second disc member 234 of the piston 230 to apply a force onto the miniature sonobuoy 300(1), which, in turn imparts a force onto the endcap 240. The pressure in the space between the endcap 280 of the second adapter member 250 and the piston 230 of the first adapter member 210 increases until the force imparted onto the endcap 240 is enough to shear the shear clips 242. This results in the endcap 240, the first miniature sonobuoy 300(1), and the piston 230 being launched or expelled from the central passage 218 of the first adapter member 210, and ultimately from the cavity 132 of the SLC 100 via the opening 112 of the first end 110 of the SLC 100.

Figure 3C:
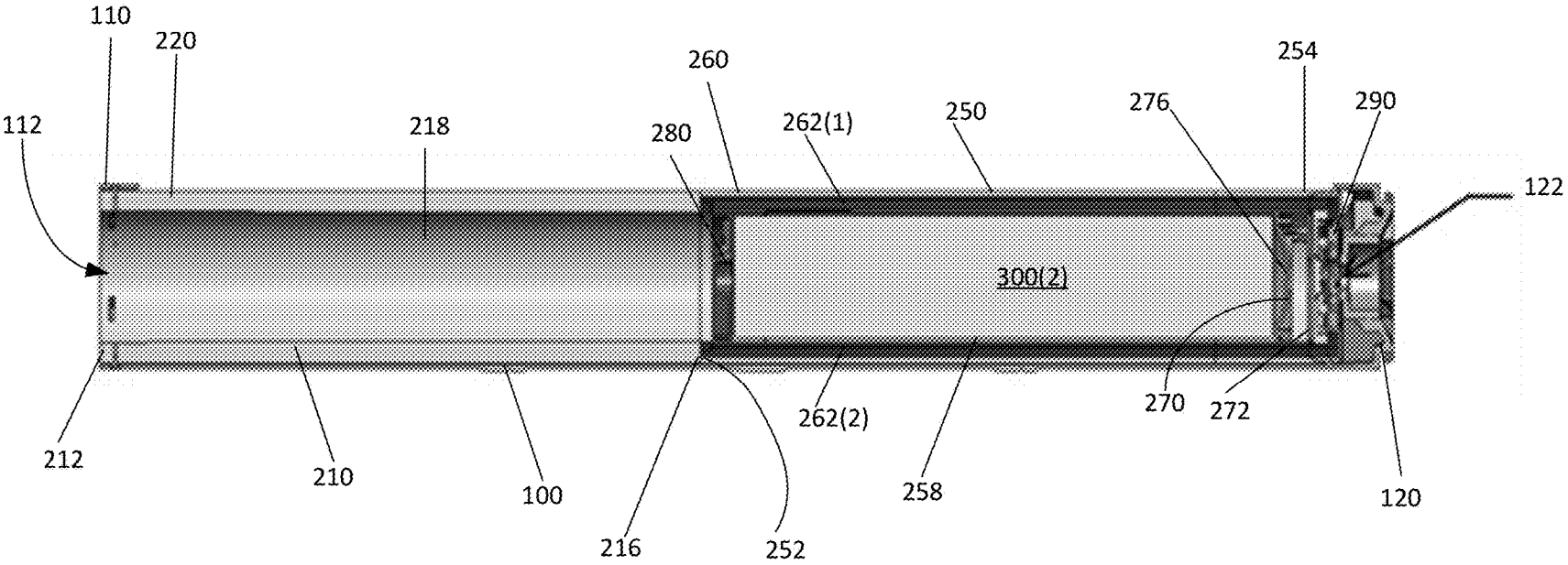

FIG. 3C illustrates the SLC 100 and the adapter kit 200 after the first miniature sonobuoy 300(1) has been launched. As illustrated, the first adapter member 210 no longer contains the endcap 240, the first miniature sonobuoy 300(1), and the piston 230 within the central passage 218. However, because the diverter mechanism 290 diverted the first burst of air through the channels 262(1), 262(2), the second miniature sonobuoy 300(2) is still disposed within the central passage 258 of the second adapter member 250. As previously explained, the endcap 280 retains the second miniature sonobuoy 300(2) and the piston 270 within the central passage 258 of the second adapter member 250. As further detailed below, after receiving the first burst of air, the diverter mechanism 290 resets to divert subsequent bursts of air through the central passage 258 of the second adapter member 250 in order to launch the second miniature sonobuoy 300(2).

Figure 3D:
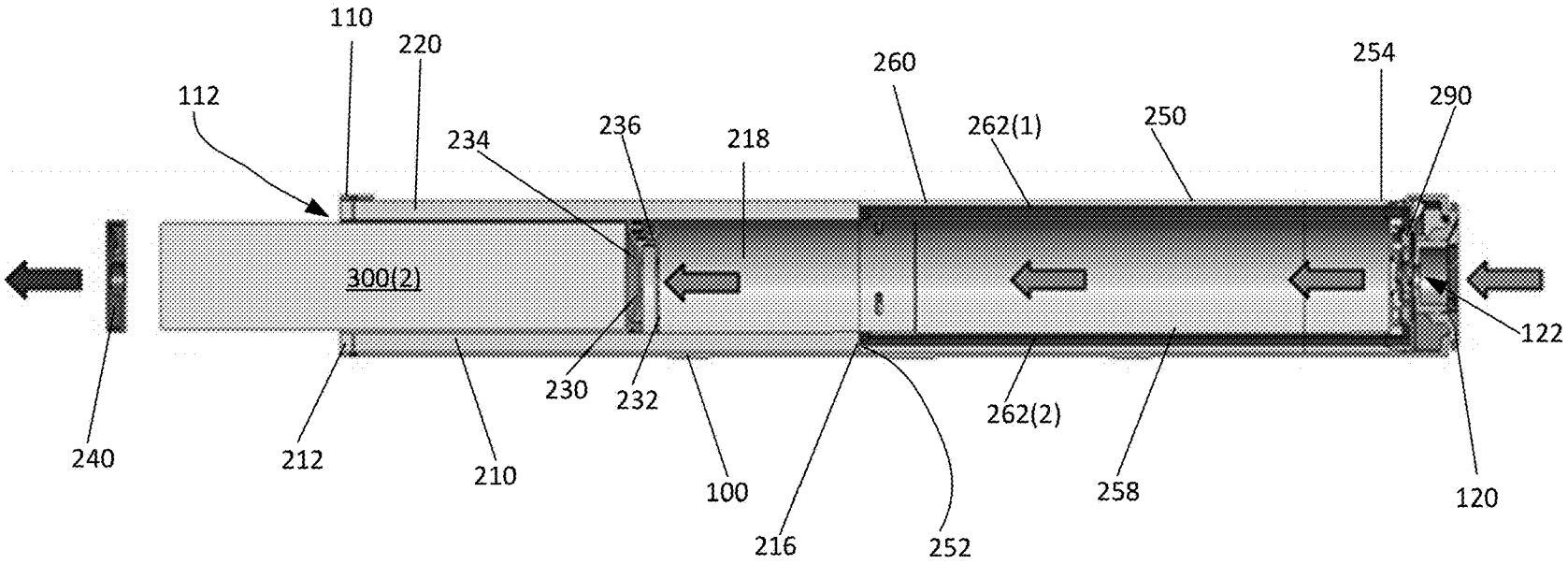

As illustrated in FIG. 3D, when the SLC 100 receives the second burst of air from the pneumatic launching mechanism, the air travels into the diverter mechanism 290 via the aperture 122 on the second end 120 of the SLC 100, where the diverter mechanism 290 diverts the second burst of air into the central passage 258 of the second adapter member 250. The second burst of air is configured to act on the first disc member 272 of the piston 270, causing the first disc member 272 to slightly deform (i.e., become concave). Because the first disc member 272 is spaced from the second disc member 274 via the support members 276, the first disc member 272 is free to deform when the pressure or force of the air burst is applied to the first disc member 272. The deformation of the first disc member 272 of the piston 270 at least partially forms a seal with the interior surface of the sidewall 260 that forms the central passage 258 of the second adapter member 250. The force or pressure from the second burst of air causes the second disc member 274 of the piston 270 to impart a force onto the second miniature sonobuoy 300(2), which in turn imparts a force onto the endcap 280. The pressure applied to the piston 270 of the second adapter member 250 increases until the force imparted onto the endcap 280 is enough to shear the shear clips 282. This results in the endcap 280, the second miniature sonobuoy 300(2), and the piston 270 being launched or expelled from the central passage 258 of the second adapter member 250, through the central passage 218 of the first adapter member 210, and, ultimately, from the cavity 132 of the SLC 100 via the opening 112 of the first end 110 of the SLC 100.

Figure 4:
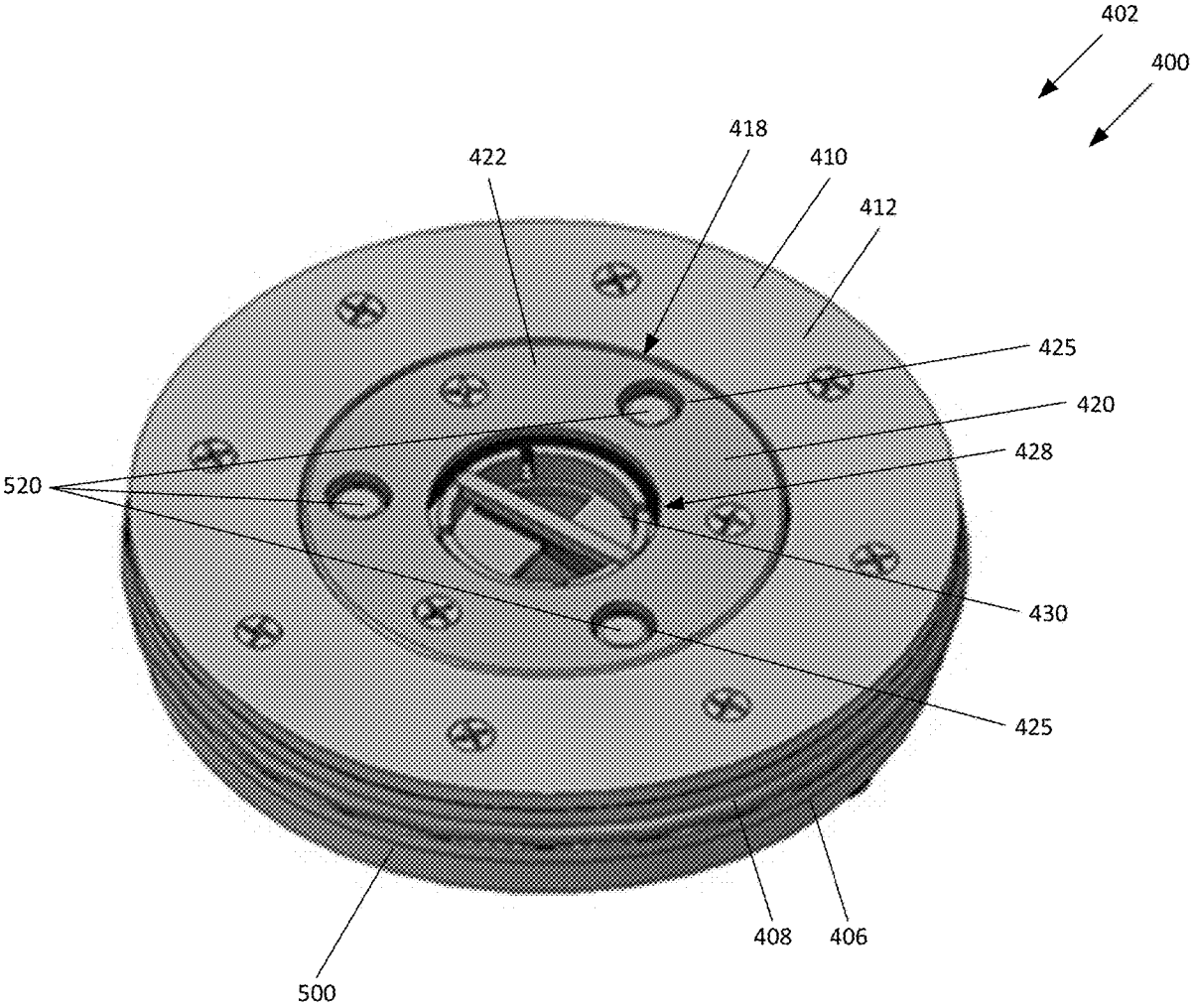
FIG. 4 illustrates a perspective view of the first embodiment of the pneumatic air diverter valve of the embodiment of the miniature sonobuoy adapter kit illustrated in FIG. 2.
Figure 5:
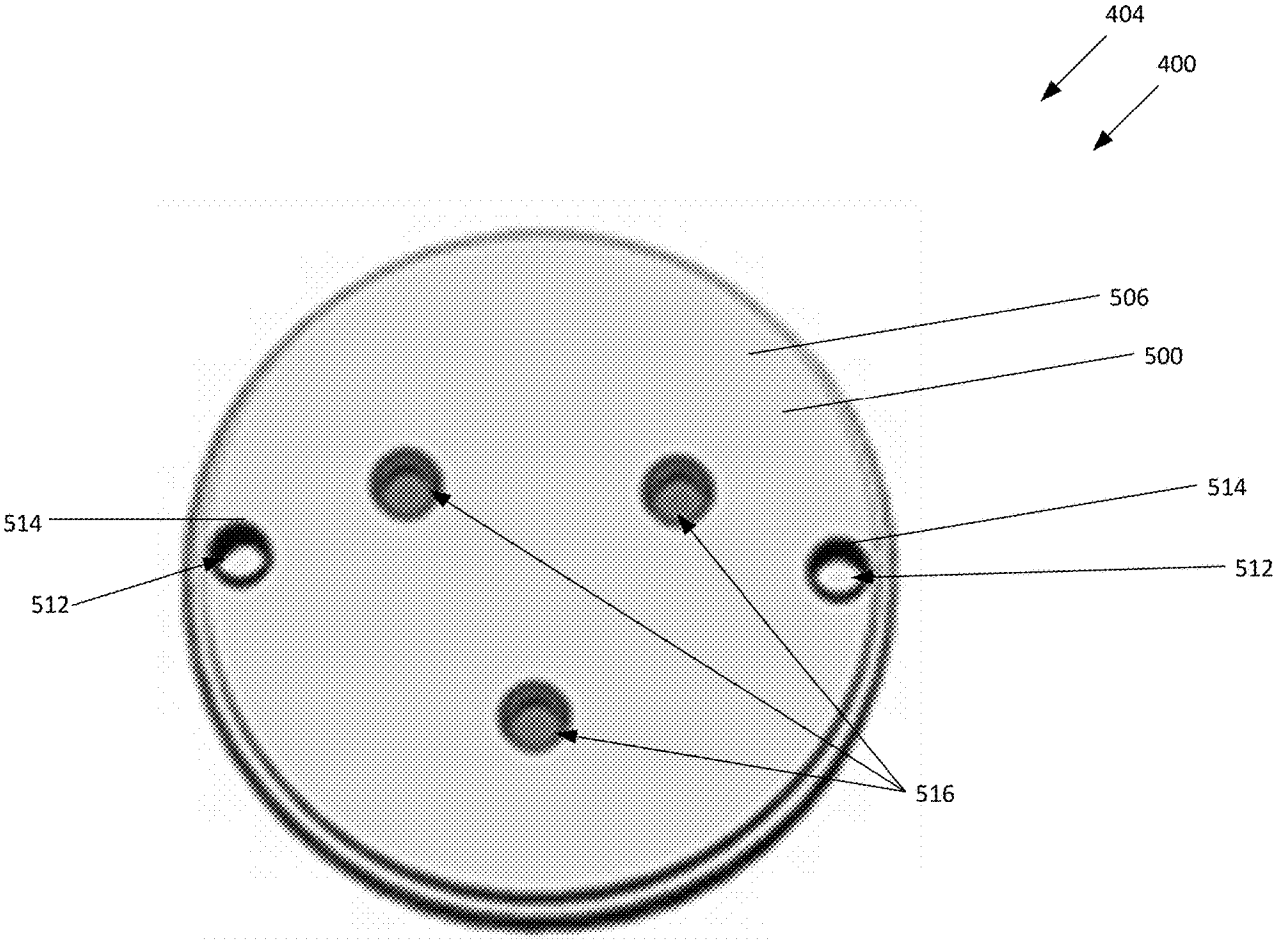
FIG. 5 illustrates a bottom view of the first embodiment of the pneumatic air diverter valve illustrated in FIG. 4.

Turning to FIGS. 4-8, 9A-9B, 10, and 11A-11F, illustrated is a first embodiment of the diverter mechanism 290, where the diverter mechanism 290 is a rotary disc mechanism 400. As illustrated in FIGS. 4 and 5, the rotary disc mechanism 400 is substantially disc-shaped with a top side 402, an opposite bottom side 404, and a sidewall 406 spanning between the top side 402 and the bottom side 404. As best illustrated in the exploded view of FIG. 6, the rotary disc mechanism 400 is collectively formed from a plurality of components, including, a base 500, a piston 460, a rotary disc 440, a rotary spring 430, a rotary cover 420, and a top cover 410.

Figure 7:
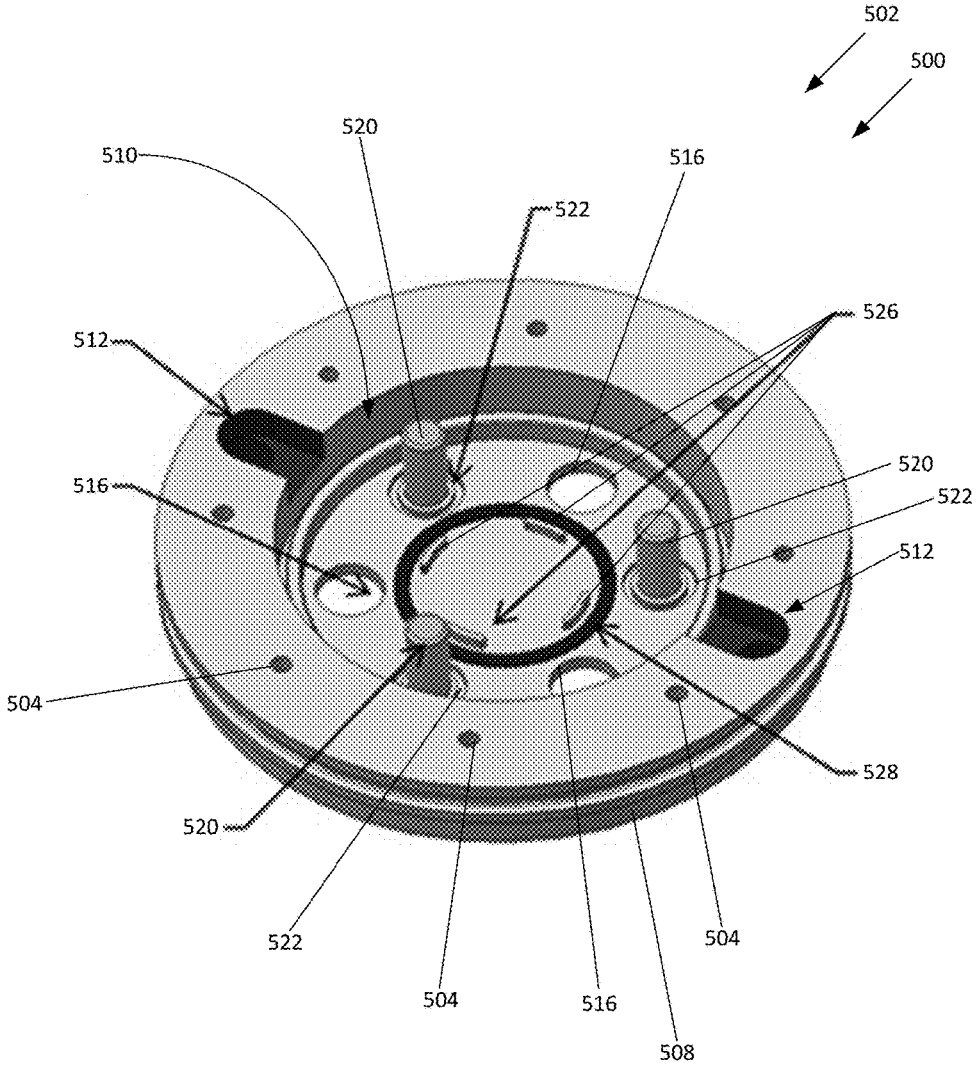
FIG. 7 illustrates a perspective view of a base portion of the first embodiment of the pneumatic air diverter valve illustrated in FIG. 4.

The base 500, as illustrated in FIGS. 5 and 7, includes a top side 502, a bottom side 506, and a sidewall 508 spanning between the top side 502 and the bottom side 506. As illustrated in FIG. 5, the bottom side 506 of the base 500 serves as the bottom side 404 of the rotary disc mechanism 400. Furthermore, the sidewall 508 of the base 500 serves primarily as the sidewall 406 of the rotary disc mechanism 400. Returning to FIG. 7, centrally disposed within the top side 502 of the base 500 is a central cavity 510. Furthermore, also disposed within the top side 502 of the base 500 is a plurality of apertures 504, where the apertures 504 are oriented annularly around the central cavity 510. As further explained below, the annular apertures 504 are configured to at least partially receive the fastener 417 of the top cover 410.

FIG. 7 further illustrates that a pair of outer openings 512 are disposed in the top side 502 of the base 500 such that the outer openings are in fluid communication with the central cavity 510. As illustrated in FIGS. 5 and 7, the outer openings 512 are through holes that extend through the base 500 from the top side 502 to the bottom side 506. FIG. 5 illustrates that each of the outer openings 512 includes a boss or flange 514 that extends from the bottom side 506 of the base 500 proximate to, and disposed around, the outer openings 512. When the bottom surface 506 of the base 500 of the rotary disc mechanism 400 is in abutment with the second end 254 of the second adapter member 250, the bosses 514 of the outer openings 512 are configured to be at least partially disposed within the proximal ends 266(1), 266(2) of the channels 262(1), 262(2) such that the outer openings 512 of the base 500 are in fluid communication with the channels 262(1), 262(2) of the second adapter member 250. Thus, the bosses 514 are configured to align the base 500, and as a result, the rotary disc mechanism 400, with the second adapter member 250 such that the outer openings 512 are in fluid communication with the channels 262(1), 262(2) of the second adapter member 250. In addition, the bosses 514 are also configured to form a seal between the channels 262(1), 262(2) of the second adapter member 250 and the outer openings 512 such that, as the rotary disc mechanism 400 diverts received air through the outer openings 512 and into the channels 262(1), 262(2) of the second adapter member 250, air does not escape between the rotary disc mechanism 400 and the second adapter member 250.

As best illustrated in FIG. 7, disposed within the central cavity 510 of the base 500 are a series of inner openings 516. In the embodiment illustrated in FIGS. 5 and 7, the central cavity 510 of the base 500 includes three inner openings 516 (through holes) that extend through the central cavity 510 to the bottom side 506 of the base 500. When the bottom surface 506 of the base 500 of the rotary disc mechanism 400 is in abutment with the second end 254 of the second adapter member 250, the inner openings 516 are aligned with the central passage 258 of the second adapter member 250 such that the inner openings 516 are in fluid communication with the central passage 258. The inner openings 516 are equally spaced around the periphery of the central cavity 510, where the inner openings 516 are offset from one another by approximately 120 degrees around the periphery of the central cavity 510.

Figure 6:
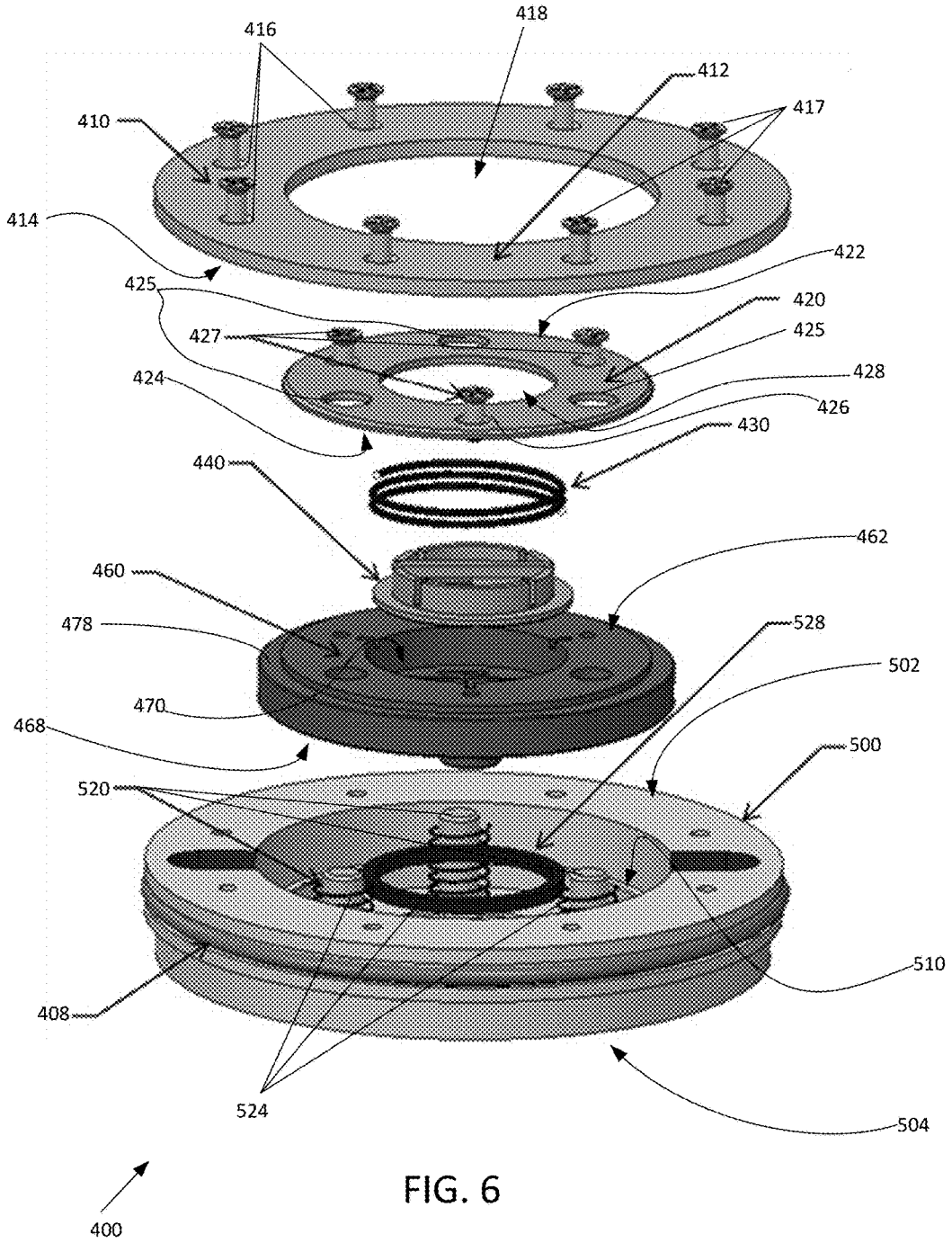
FIG. 6 illustrates an exploded view of the first embodiment of the pneumatic air diverter valve illustrated in FIG. 4.

Also disposed within the central cavity 510 of the base 500 is a series of piston guide pins 520. In the embodiment illustrated in FIGS. 5 and 7, the central cavity 510 of the base 500 includes three guide pins 520 that extend upwardly through the central cavity 510 toward the top side 502 of the base 500. Like the inner openings 516, the guide pins 520 are equally spaced around the periphery of the central cavity 510 where the guide pins 520 are offset from one another by approximately 120 degrees around the periphery of the central cavity 510. As further illustrated, each guide pin 520 is disposed half way between two inner openings 516 along the periphery of the central cavity 510 such that the guide pins 520 and the inner openings 516 are oriented in an alternating fashion around the periphery of the central cavity 510. Disposed around the base (i.e., the coupling of the guide pins 520 to the central cavity 510) of each guide pin 520 is a groove or depression 522. Furthermore, as best illustrated in FIG. 6, a resilient member or spring 524 is disposed around each of the guide pins 520. Each resilient member 524 is positioned around its respective guide pin 520 and at least partially disposed within the groove 522. Thus, grooves 522 retain each resilient member 524 in position around the guide pins 520.

Continuing with FIG. 7, the central cavity 510 of the base 500 also includes a plurality of tabs 526 disposed centrally within the central cavity 510. In the embodiment illustrated in FIG. 7, the central cavity 510 includes four arcuate tabs 526 that are equally spaced from one another while being disposed inward from the guide pins 520 and the inner openings 516. The tabs 526 are oriented with respect to one another such that the tabs 526 partially form the outline of a circle, where the tabs 526 are offset by approximately 90 degrees from one another. The tabs 526 extend upwardly through the central cavity 510 toward the top side 502 of the base 500. FIG. 7 further illustrates a seal or gasket ring 528 concentrically disposed within the central cavity 510, and also around the tabs 526. Moreover, the gasket ring 528 is disposed radially inward from the guide pins 520 and the inner openings 516 (i.e., the gasket ring 528 is more centrally disposed than the guide pins 520 and the inner openings 516).

Figure 8:
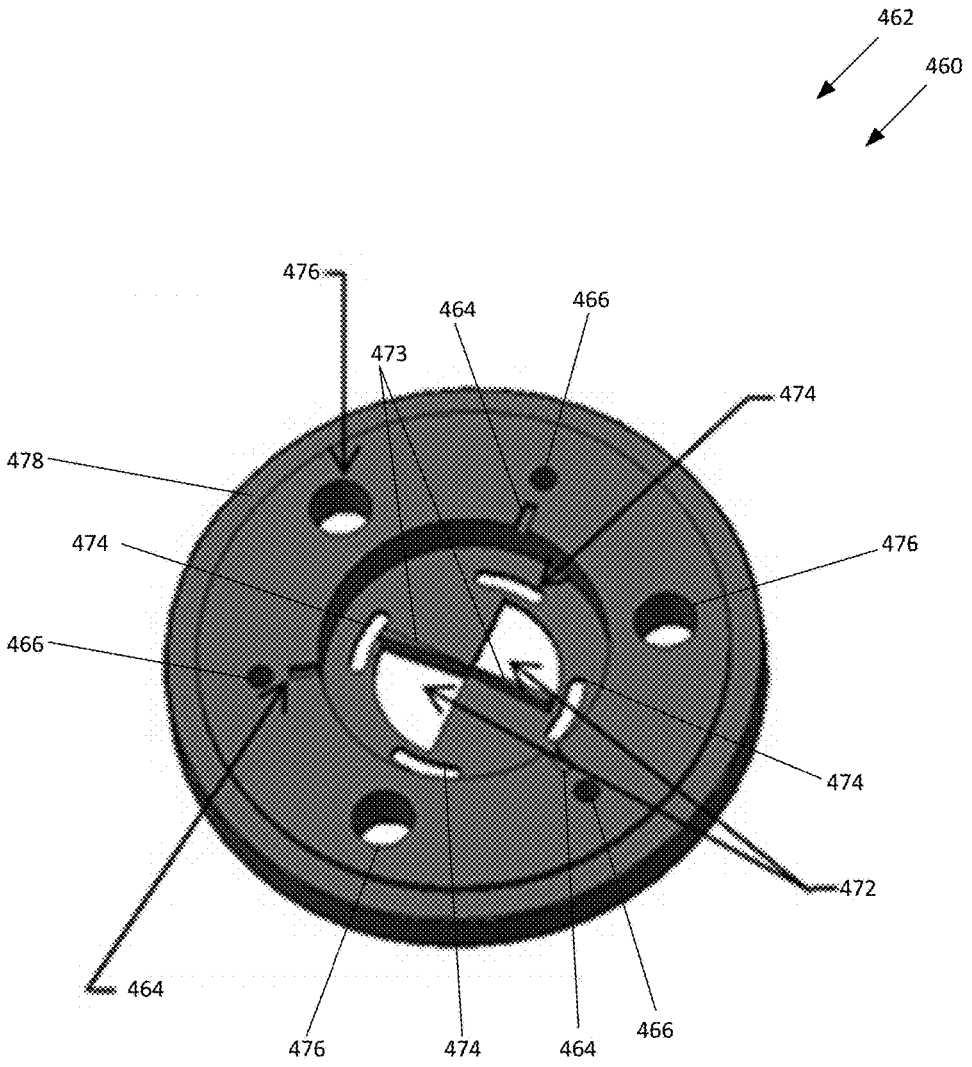
FIG. 8 illustrates a perspective view of a piston of the first embodiment of the pneumatic air diverter valve illustrated in FIG. 4.

Turning to FIGS. 6 and 8, illustrated is the piston 460 of the rotary disc mechanism 400. As best illustrated in FIG. 6, the piston 460 is configured to be slidably disposed within the central cavity 510 of the base 500. Thus, the piston 460 is approximately the same diameter as that of the central cavity 510. However, as will be further detailed below, the height or thickness of the piston 460 is less than that of the height or depth of the central cavity 510 of the base 500. The piston 460 is substantially disc-shaped with a top side 462 and a bottom side 468. Like the base 500, disposed centrally within the top side 462 of the piston 460 is a cavity 470. Moreover, disposed in the top side 462 of the piston 460 is a plurality of apertures 466 (e.g., blind holes), where the apertures 466 are oriented annularly around the cavity 470. As further explained below, the annular apertures 466 are configured to at least partially receive the fasteners 427 of the rotary cover 420. Also disposed in the top side 462 of the piston 460 is a plurality of openings 476, where, like the annular apertures 466, the openings 476 are oriented annularly around the cavity 470. The annular openings 476 are through holes that extend entirely through the piston 460 from the top side 462 to the bottom side 468. The annular openings 476 are larger in diameter than the annular apertures 466, and are configured to slidably receive the piston guide pins 520 of the base 500. Thus, the piston 460 slides along the piston guide pins 520 of the base 500 (i.e., the guide pins 520 slide through the annular openings 476) when the piston 640 moves up and down through the central cavity 510 of the base 500.

FIGS. 6 and 8 further illustrate an annular indentation or depression 478 within the top side 462 of the piston 460. The depression 478 is disposed along the outer edge of the top side 462 of the piston 460 such that the depression 478 extends along the outer periphery of the top side 462 of the piston 460.

The top side 462 of the piston 460 also includes a series of radial slits 464 that at least partially extend outwardly from the cavity 470 through the top side 462 of the piston 460. In the embodiment illustrated, the piston 460 includes three slits 464 that are aligned with the three annular apertures 466. However, other embodiments of the piston 460 may include any number of slits 464, and the slits 464 may not be aligned with the annular apertures 466.

As best illustrated in FIG. 8, the cavity 470 of the piston 460 is substantially circular and includes two air ports 472 centrally disposed within the cavity 470 and plurality of equally spaced annular slots 474 disposed around the air ports 472. Like the tabs 526 of the central cavity 510 of the base 500, the slots 474 are oriented with respect to one another such that the slots 474 partially form the outline of a circle (i.e., around the periphery of the base of the cavity 470), where the slots 474 are offset by approximately 90 degrees from one another. The slots 474 extend through the cavity 670 to the bottom side 468 of the piston 460. Moreover, the slots 474 are substantially equal in length to the tabs 526 of the central cavity 510 of the base 500. Furthermore, the air ports 472 disposed within the cavity 470 are substantially triangular or pie shaped (e.g., the two air ports may constitute two opposing quadrants of a circle as shown in the example in FIG. 8) and, like the slots 474, extend through the cavity 470 to the bottom side 468 of the piston 460. As illustrated, a linear walled member 473 extends through the air ports 472 such that the walled member 473 is disposed on only one side of each of the air ports 472. In other embodiments, the piston 460 may contain any number of air ports 472.

Figure 9B:
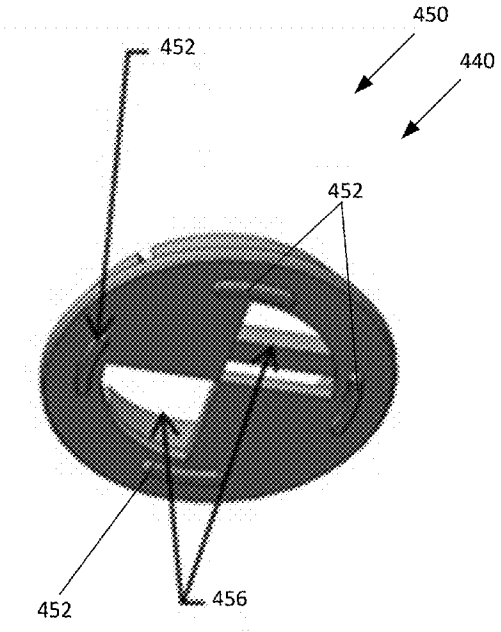
FIG. 9B illustrates a perspective view of a bottom of the rotary disc illustrated in FIG. 9A.
Figure 9A:
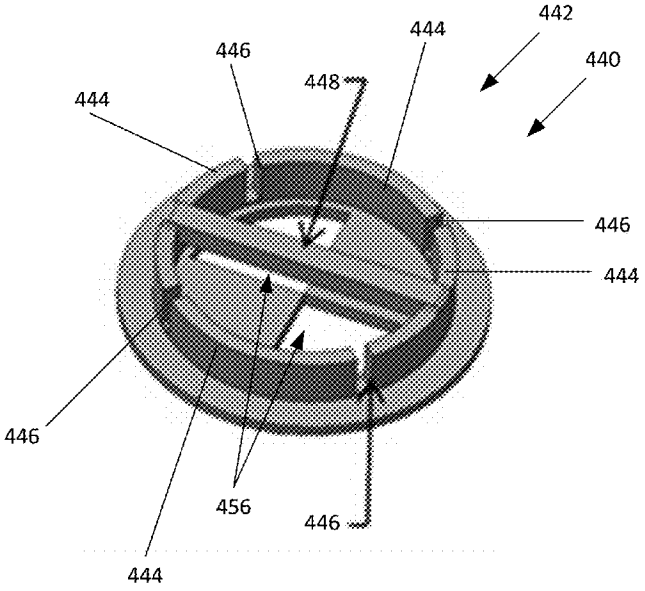
FIG. 9A illustrates a perspective view of a top of a rotary disc of the first embodiment of the pneumatic air diverter valve illustrated in FIG. 4.

Turning to FIGS. 6, 9A, and 9B, illustrated is the rotary disc 440 of the rotary disc mechanism 400. As best illustrated in FIG. 6, the rotary disc 440 is configured to rotatably disposed within the cavity 470 of the piston 460 such that the rotary disc 440 rotates about a substantially vertical axis that is concentric to both the rotary disc 440 and the piston 460. Thus, the rotary disc 440 is approximately the same diameter as that of the cavity 470 of the piston 460. The rotary disc 440 is substantially disc-shaped with a top side 442 and a bottom side 450. As best illustrated in FIG. 9A, extending upwardly from the top side 442 of the rotary disc 440 is a series of annular flanges 444. The flanges 444 are oriented annularly about the top side 442 of the rotary disc 440 such that the flanges 444 collectively form a circular shape. FIG. 9A further illustrates that a slit 446 is disposed between each one of the flanges 444. Thus, in the embodiment illustrated in FIGS. 6, 9A, and 9B, the rotary disc 440 include four upstanding flanges 444 and four slits 446. Other embodiments of the rotary disc 440 may include any number of flanges 444 and slits 446. Furthermore, FIG. 9A also illustrates a lever or cross-member 448 extends between two flanges 444 that oppose one another such that the cross-member 448 extends across a portion of the top side 442 of the rotary disc 440.

As best illustrated in FIG. 9B, the bottom side 450 of the rotary disc 440 includes a series of four locking tabs 452 that are equally spaced around the periphery of the bottom side 450 of the rotary disc 440. The locking tabs 452 extend downward from the bottom side 450 of the rotary disc 440. Similar to the tabs 526 of the central cavity 510 of the base 500 and the slots 474 of the cavity 470 of the piston 460, the tabs 452 are oriented with respect to one another such that the tabs 452 partially form the outline of a circle (i.e., around the periphery of the bottom side 450 of the rotary disc 440), where the tabs 452 are offset by approximately 90 degrees from one another. In addition, the tabs 452 are substantially equal in length to the tabs 526 of the central cavity 510 of the base 500 and the slots 474 of the cavity 470 of the piston 460.

The rotary disc 440 also includes a pair of air ports 456 that extend through the rotary disc 440 from the top side 442 to the bottom side 450. Like the air ports 472 of the cavity 470 of the piston 460, the air ports 456 of the rotary disc 440 are substantially triangular or pie shaped and approximately equal in size to the air ports 472 of the cavity 470 of the piston 460. Furthermore, the number of air ports 456 of the rotary disc 440 are equal to the number of air ports 472 of the cavity 470 of the piston 460.

Returning to FIG. 6, a rotational or torsional spring 430 is disposed around the rotary disc 440 and disposed within the cavity 470 of the piston 460. While not illustrated, the torsional spring 430 may include flanges or extension members that are configured to interact with both the slits 446 of the rotary disc 440 and the slits 464 of the piston 460. The torsional spring 430 is configured to bias the rotary disc 440 to a position where the air ports 456 of the rotary disc 440 are aligned with the air ports 472 of the cavity 470 of the piston 460.

FIG. 6 further illustrates a rotary cover 420 that is configured to be disposed on, and coupled to, the piston 460. The rotary cover 420 is also disc-shaped with a top side 422 and a bottom side 424. The rotary cover 420 includes a central opening 428 that extends through the rotary cover 420 from the top side 422 to the bottom side 424. The central opening 428 is substantially equal in diameter to that of the cavity 470 of the piston 460. Moreover, like the piston 460, the rotary cover 420 includes a plurality of apertures 426 and a plurality of openings 425 that are disposed annularly around the central opening 428. The annular openings 425 are substantially equal in diameter to that of the annular openings 476 of the piston 460. Furthermore, the annular apertures 426 may be substantially equal in diameter to that of the annular apertures 466 of the piston 460. Additionally, the annular apertures 426 of the rotary disc 420 are configured to be aligned with the annular apertures 466 of the piston, while the annular openings 425 of the rotary disc 420 are configured to be aligned with the annular openings 476 of the piston 460. Thus, a fastener 427 (e.g., a screw, pin, bolt, etc.) may be inserted through the annular apertures 426 of the rotary disc 420 and at least partially through the annular apertures 466 of the piston 460 to secure the bottom side 424 of the rotary disc 420 to the top side 462 of the piston 460. When secured to the top side 462 of the piston 460, the rotary disc 420 covers the slits 464 in which portions of the torsional spring 430 are inserted to secure the torsion spring 430 within the cavity 470 of the piston 460. Furthermore, the rotary disc 420 has a diameter substantially equal to that of the portion of the top side 462 of the piston that is disposed inward from the depression 478 such that, when the rotary disc 420 is secured to the top side 462 of the piston 460, the rotary disc 420 does not cover the depression 478 of the piston 460.

In addition, FIG. 6 illustrates a top cover 410 that is configured to be disposed on, and coupled to, the base 500. The top cover 410 is disc-shaped with a top side 412 and a bottom side 414. As illustrated, the top cover 410 includes a central opening 418 that extends through the top cover 410 from the top side 412 to the bottom side 414. The central opening 418 of the top cover 410 contains a diameter that is slightly smaller than the diameter of the central cavity 510 of the base 500 and the diameter of the piston 460. More specifically, the diameter of the top cover 410 is equal to the diameter of the rotary cover 420 and the portion of the top side 462 of the piston 460 that is disposed inward from the depression 478. When the bottom side 414 of the top cover 410 is disposed on the top side 502 of the base 500, the bottom side 414 of the top cover 410 at least partially covers the depression 478 of the piston 460.

The top cover 410 also includes a series of apertures 416 that are oriented annularly around the central opening 418 of the top cover 410. The annular apertures 416 of the top cover 410 are configured to align with the annular apertures 504 disposed on the top side 502 of the base 500. Thus, when the bottom side 414 of the top cover 410 is disposed on the top side 502 of the base 500, fasteners 417 (e.g., screws, pins, bolts, etc.) may be inserted through the annular apertures 416 of the top cover 410 and at least partially into the annular apertures 504 of the base 500 to secure the top cover 410 to the base 500. When the top cover 410 is secured to the base 500, the piston 460, rotary disc 440, torsional spring 430, and rotary cover 420 are secured to the base 500 with the capability of sliding throughout the central cavity 510 of the base 500.

Returning to FIG. 4, the top side 402 of the rotary disc mechanism 400 is collectively formed from the top side 412 of the top cover 410, the top side 422 of the rotary cover 420, the ends of the guide pins 520, and the rotary disc 440. As illustrated, the rotary disc 440 is visible through the central opening 428 of the rotary cover 420, while the ends of the guide pins 520 are visible through the annular openings 425 of the rotary cover 420. In addition, the rotary cover 420, guide pins 520, and rotary disc 440 are visible through the central opening 418 of the top cover 410.

Turning to FIG. 10, illustrated is the rotary disc mechanism 400 disposed within the cavity 132 of the SLC 100 proximate to the second end 120 of the SLC 100, where the SLC 100 is illustrated with a cutaway portion that is for illustrative purposes only. When disposed within the cavity 132, the O-ring 408 of the rotary disc mechanism 400 forms a seal along the inner surface of the sidewall 130 that forms the cavity 132. Moreover, the rotary disc 440 is disposed proximate to, and in fluid communication with, the aperture 122 of the second end 120 of the SLC 100 such that air is capable of traveling through the apertures 122 of the second end 120 of the SLC 100 and into the rotary disc mechanism 400 via the rotary disc 440 and the piston 460.

Figure 11A:
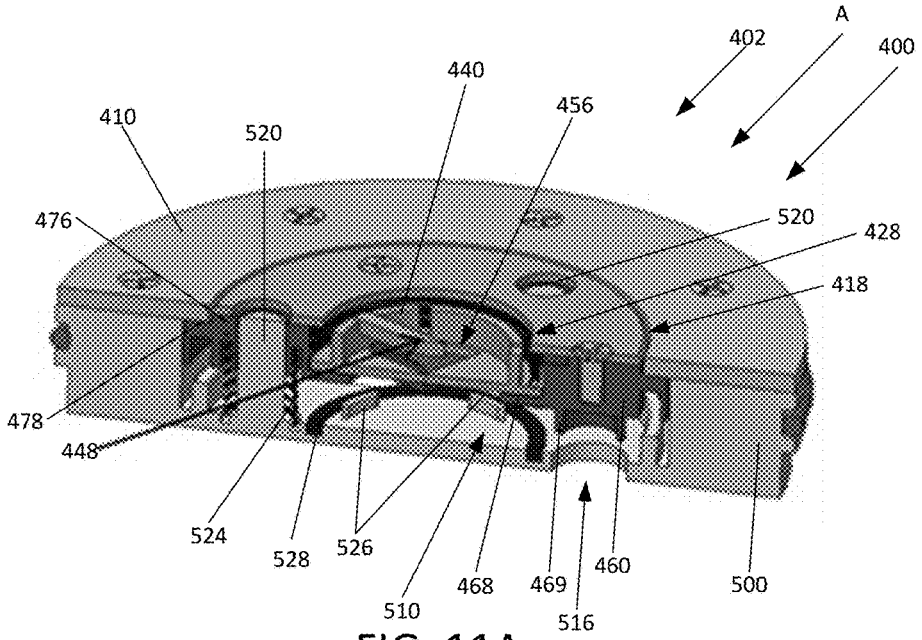
FIGS. 11A-11F illustrate cross-sectional view of the operational stages of the first embodiment of the pneumatic air diverter valve illustrated in FIG. 5.

FIGS. 11A-11F illustrate the cross-sectional views of the operation and various positions of the components of the rotary disc mechanism 400 during the various stages of launching two miniature sonobuoys 300(1), 300(2), as illustrated in FIGS. 3A-3D. As illustrated in FIG. 11A, the rotary disc mechanism 400 is oriented in static stage A, which occurs prior to the rotary disc mechanism 400 receiving a first burst of air from the pneumatic launching mechanism. The resilient members 524 disposed around the guide pins 520 bias the piston 460 towards an upward position within the central cavity 510 of the base 500, where the depression 478 of the piston 460 is in abutment with the top cover 410. Moreover, in this first static position A, the rotary disc 440 is rotated into the locked position, where the air ports 456 are not aligned with the air ports 472 of the cavity 470 of the piston 460. In addition, while not illustrated, when in the locked position, the tabs 452 on the bottom side 450 of the rotary disc 440 are disposed within slots 474 of the cavity 470 of the piston 460 to retain the rotary disc 440 in the locked position.

Figure 11B:
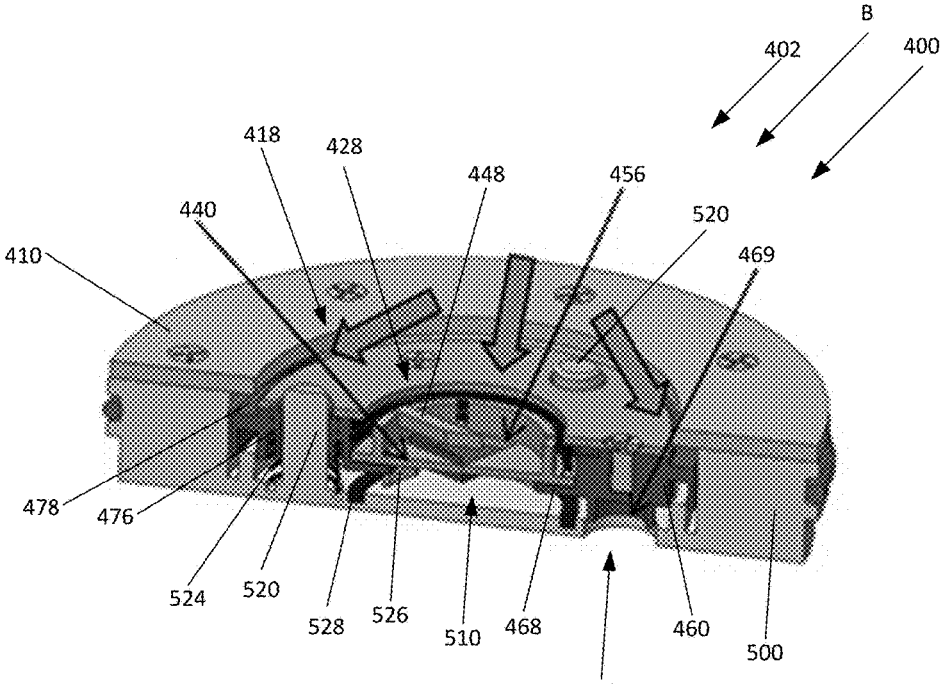
Figure 11C:
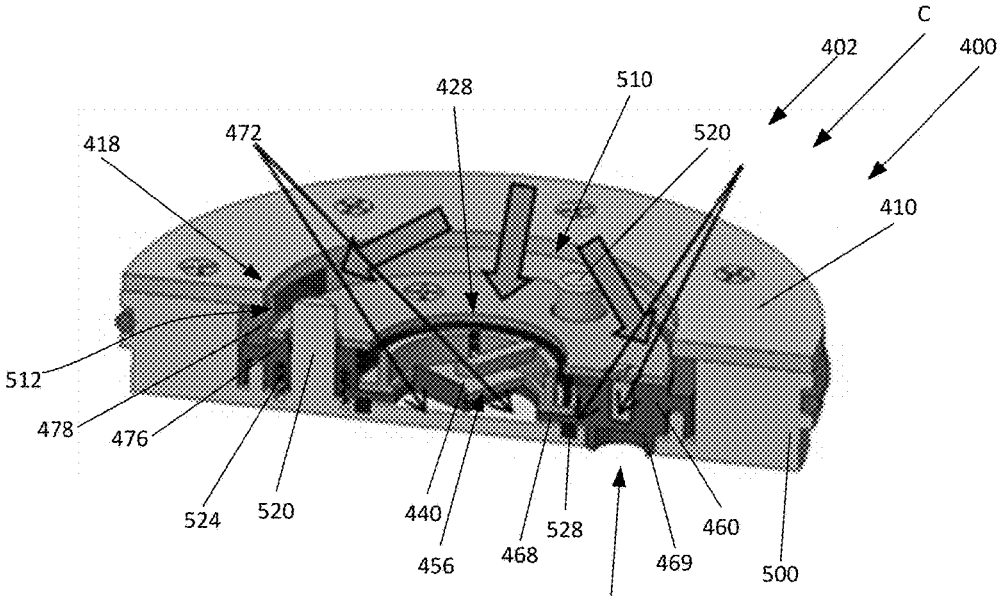

As illustrated in FIGS. 11B and 11C, when air is forced onto the top side 402 of the rotary disc mechanism 400 (i.e., air impacts the top side 402 of the rotary disc mechanism 400), the force of the air causes the piston 460 to slide downwardly through the central cavity 510 of the base 500 such that the bottom side 468 of the piston 460 moves toward the surface of the central cavity 510 of the base 500. FIG. 11B illustrates stage B, where the piston 460 has traveled along the central cavity 510 of the base 500 approximately 50% of the possible travel distance, while FIG. 11C illustrates stage C, where the piston 460 has traveled along the central cavity 510 of the base 500 approximately 100% of the possible travel distance. Because the rotary disc mechanism 400 forms a seal within the cavity 132 of the SLC 100, and because the air ports 456 of the rotary disc 440 are not aligned with the air ports 472 of the cavity 470, the air is able to force movement of the piston 460 along the guide pins 520 of the central cavity 510 of the base 500.

As illustrated, the bottom surface 468 of the piston 460 includes a series of bosses 469 that extend downwardly from the bottom surface 468. The bosses 469 of the piston 460 are aligned with the inner openings 516 of the central cavity 510 of the base 500. Thus, as the piston 460 moves from the position in stage A to the position in stage C, the bosses 469 slide into the inner openings 516 of the central cavity 510 of the base 500 to form a seal with the inner openings 516. Furthermore, as the piston 460 moves from the position in stage A to the position in stage C, the depression 478 of the piston 460 moves away from the top cover 410, such that the piston 460 moves downwardly past the outer openings 512. Once the outer openings 512 are exposed, the air being imparted onto the top side 402 of the rotary disc mechanism 400 travels through the outer openings 512, and into the channels 262(1), 262(2) of the second adapter member 250 to launch the first miniature sonobuoy 300(1) from the first adapter member 210, as previously explained.

FIG. 11C further illustrates that, when the rotary disc mechanism 400 is in stage C, the bottom surface 468 of the piston 460 is in contact with the gasket ring 528. In addition, when in stage C, the tabs 526 of the central cavity 510 of the base 500 extend upwardly through the slots 474 of the cavity 470 of the piston 460 and into abutment with the tabs 452 of the bottom side 450 of the rotary disc 440. As the tabs 526 of the central cavity 510 of the base 500 slide upward though the slots 474, the tabs 452 of the bottom side 450 of the rotary disc 440 slide out of engagement with the slots 474 of the cavity 470 of the piston 460. Once disengaged from the slots 474 of the cavity 470 of the piston 460, the torsional spring 430 forces the rotary disc 440 to rotate into the unlocked position, where the air ports 456 of the rotary disc 440 are in alignment with the air ports 472 of the cavity 470 of the piston 460. The walled member 473 prevents over rotation of the rotary disc 440 and ensures that air ports 456, 472 become aligned with one another. However, because the bottom surface 468 of the piston 460 is in abutment with the gasket ring 528 when the rotary disc mechanism 400 is in stage C, even though the rotary disc 440 is rotated to the unlocked position, air is still diverted through the outer openings 512. In other words, the first burst of air causes the inner air ports 472 to be "opened" (i.e., an inner air passage is formed), but the first burst of air does not flow through the air ports 472 due to the position of the piston 460 and the engagement of the bottom surface 468 of the piston 460 with the gasket ring 528.

Figure 11D:
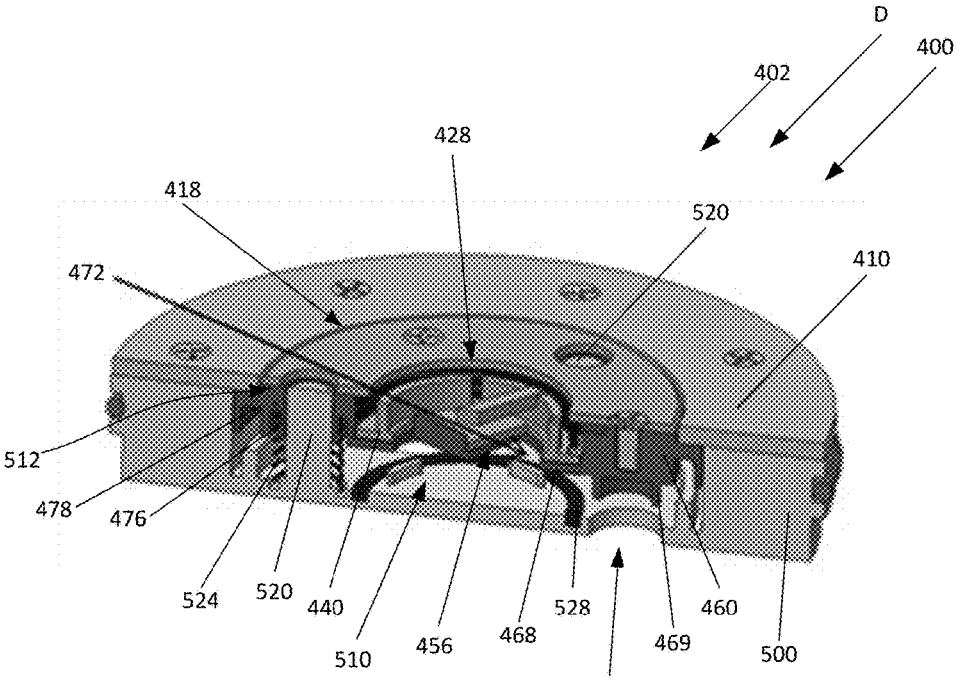

As illustrated in FIG. 11D, once the flow of air from the first burst of air has ended, the rotary disc mechanism 400 is oriented to stage D, where the resilient members 524 have returned the piston 460 to the top position within the central cavity 510 of the base 500 so that the depression 478 of the piston 460 is in abutment with the top cover 410. Moreover, in stage D, the bottom surface 468 of the piston 460 is spaced from the gasket ring 528, and the bosses 469 are no longer disposed within the inner openings 516 of the central cavity 510 of the base 500. However, unlike stage A, where the rotary disc 440 is in the locked position (i.e., the air ports 456 of the rotary disc 440 are not in alignment with the air ports 472 of the cavity 470 of the piston 460), when in stage D, the rotary disc 440 is in the unlocked position (i.e., air ports 456 of the rotary disc 440 are in alignment with the air ports 472 of the cavity 470 of the piston 460).

Figure 11E:
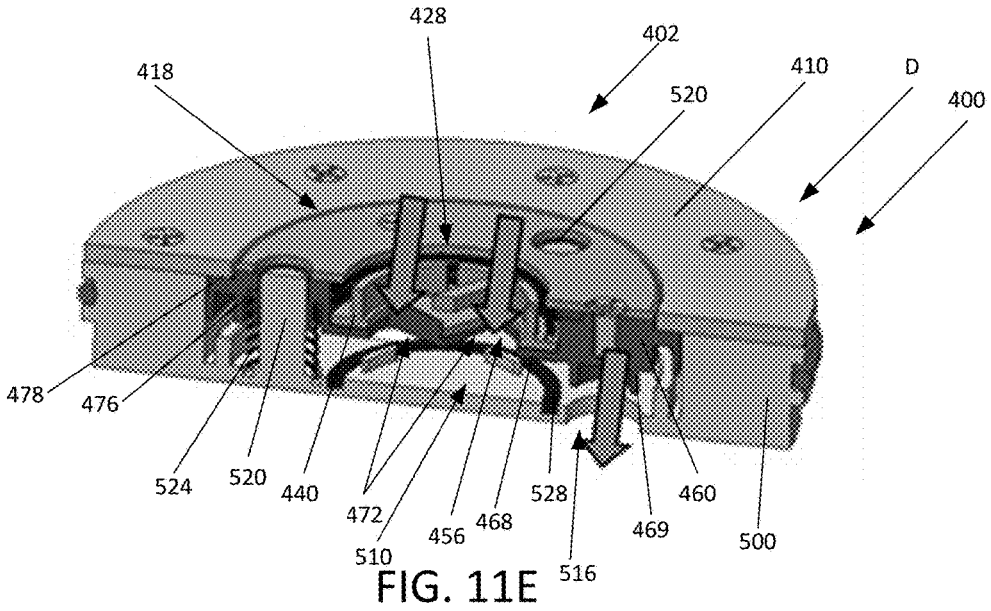
Figure 11F:
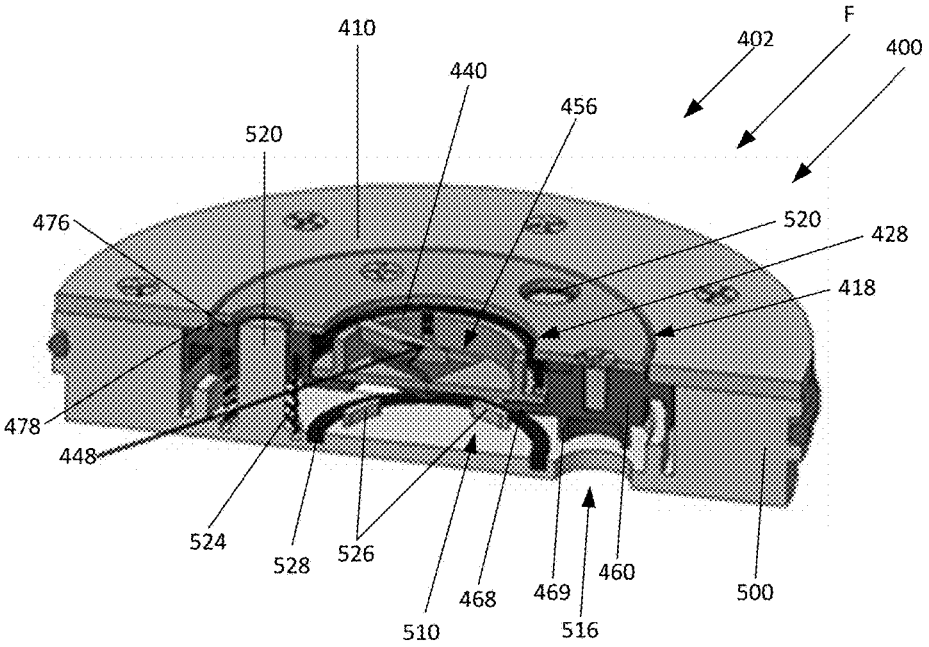

Thus, as illustrated in FIG. 11E, when the second burst of air from the pneumatic launching mechanism imparts air onto the top side 402 of the rotary disc mechanism 400, the air is capable of flowing through the air ports 456 of the rotary disc 440 and the air ports 472 of the cavity 470 of the piston 460 because the air ports 456, 472 are aligned with one another. The air is free to flow through the air ports 456, 472, into the central cavity 510 of the base 500, and through the inner openings 516 of the central cavity 510 of the base 500. As previously explained, when the air flows through the inner openings 516 of the central cavity 510 of the base 500, the air flows into the central passage 258 of the second adapter member 250 to launch the second miniature sonobuoy 300(2) from the second adapter member 250. As illustrated in FIG. 11F, after the flow of air from the second burst of air has ended, the rotary disc 440 may be rotated back into the locked position, where the tabs 452 are disposed in, and engaged with, the slots 474 of the cavity 470 of the piston 460. Thus, the rotary disc 440 and the rotary disc mechanism 400 can be reconfigured to subsequently launch two more miniature sonobuoys 300(1), 300 (2) once they are loaded within the first and second adapter members 210, 250 disposed within the SLC 100.

Figure 12:
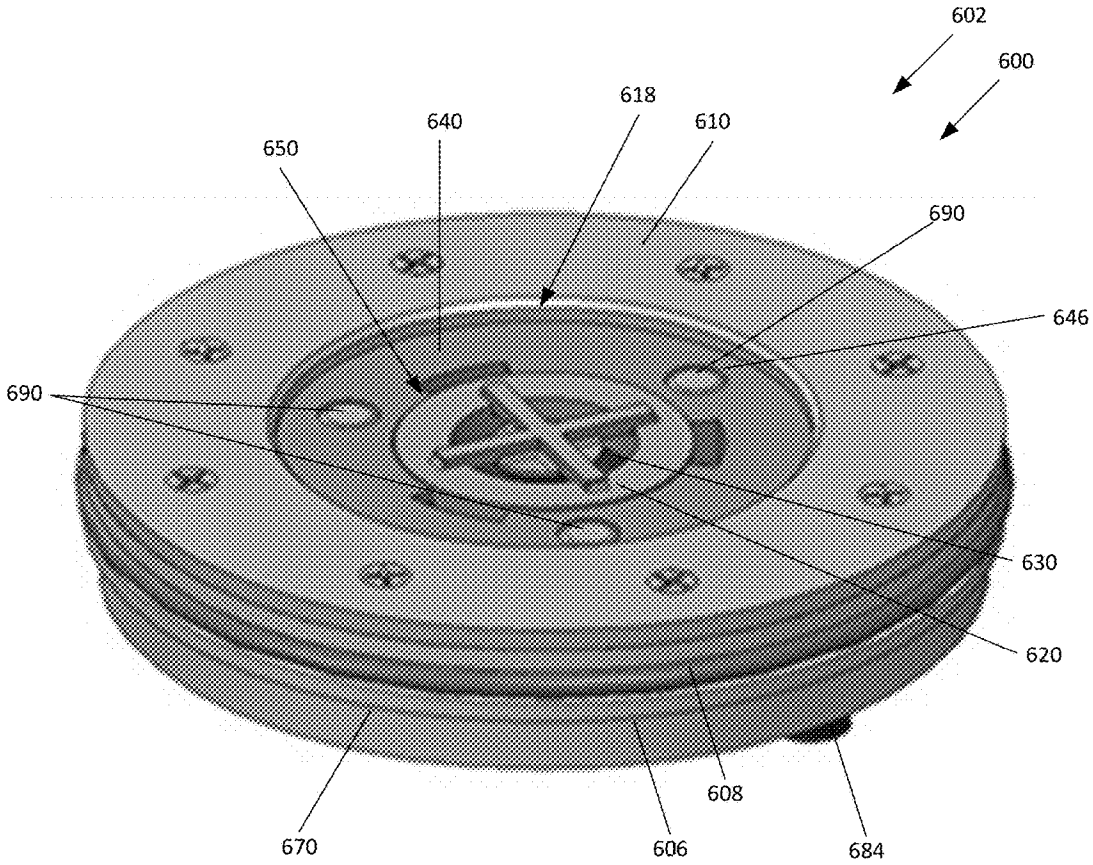
FIG. 12 illustrates a perspective view of the second embodiment of the pneumatic air diverter valve of the embodiment of the miniature sonobuoy adapter kit illustrated in FIG. 2.
Figure 13:
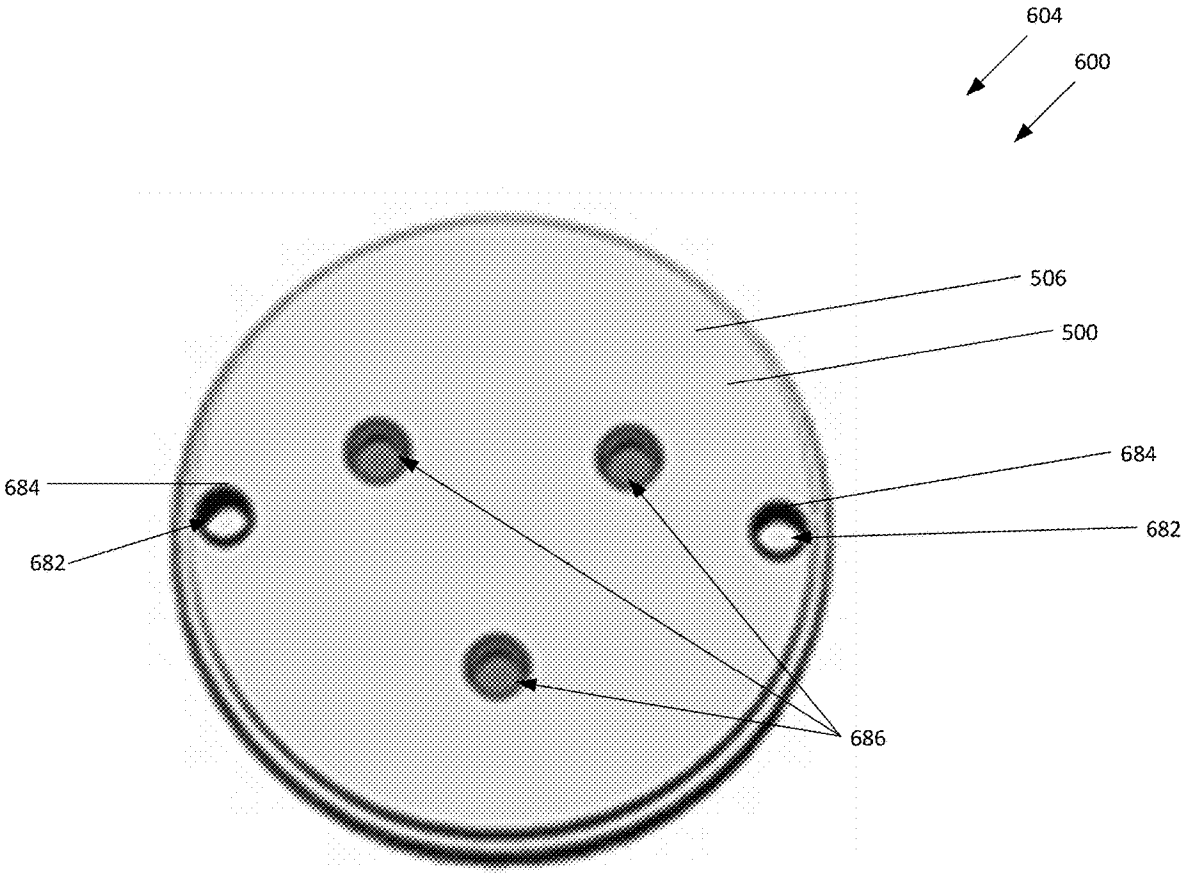
FIG. 13 illustrates a bottom view of the second embodiment of the pneumatic air diverter valve illustrated in FIG. 12.

Turning to FIGS. 12-16, and 17A-17F, illustrated is a second embodiment of the diverter mechanism 290, where the diverter mechanism 290 is a burst disc mechanism 600. As illustrated in FIGS. 12 and 13, the burst disc mechanism 600 is substantially disc-shaped with a top side 602, an opposite bottom side 604, and a sidewall 606 spanning between the top side 602 and the bottom side 604. As best illustrated in the exploded view of FIG. 14, the burst disc mechanism 600 is collectively formed from a plurality of components, including, a base 670, a piston 640, a burst disc 630, a retainer 620, and a top cover 610.

Figure 14:
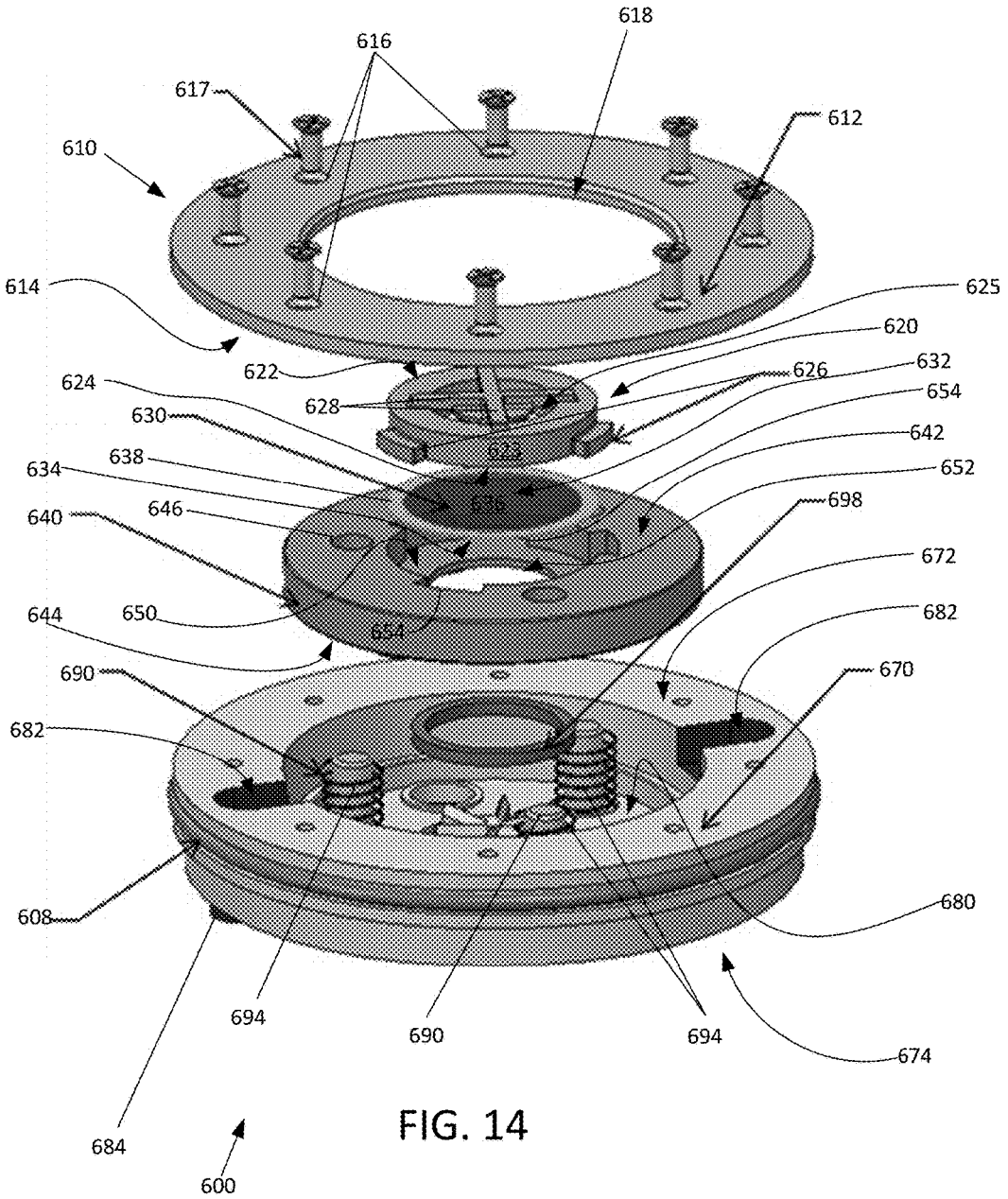
FIG. 14 illustrates an exploded view of the second embodiment of the pneumatic air diverter valve illustrated in FIG. 12.
Figure 15:
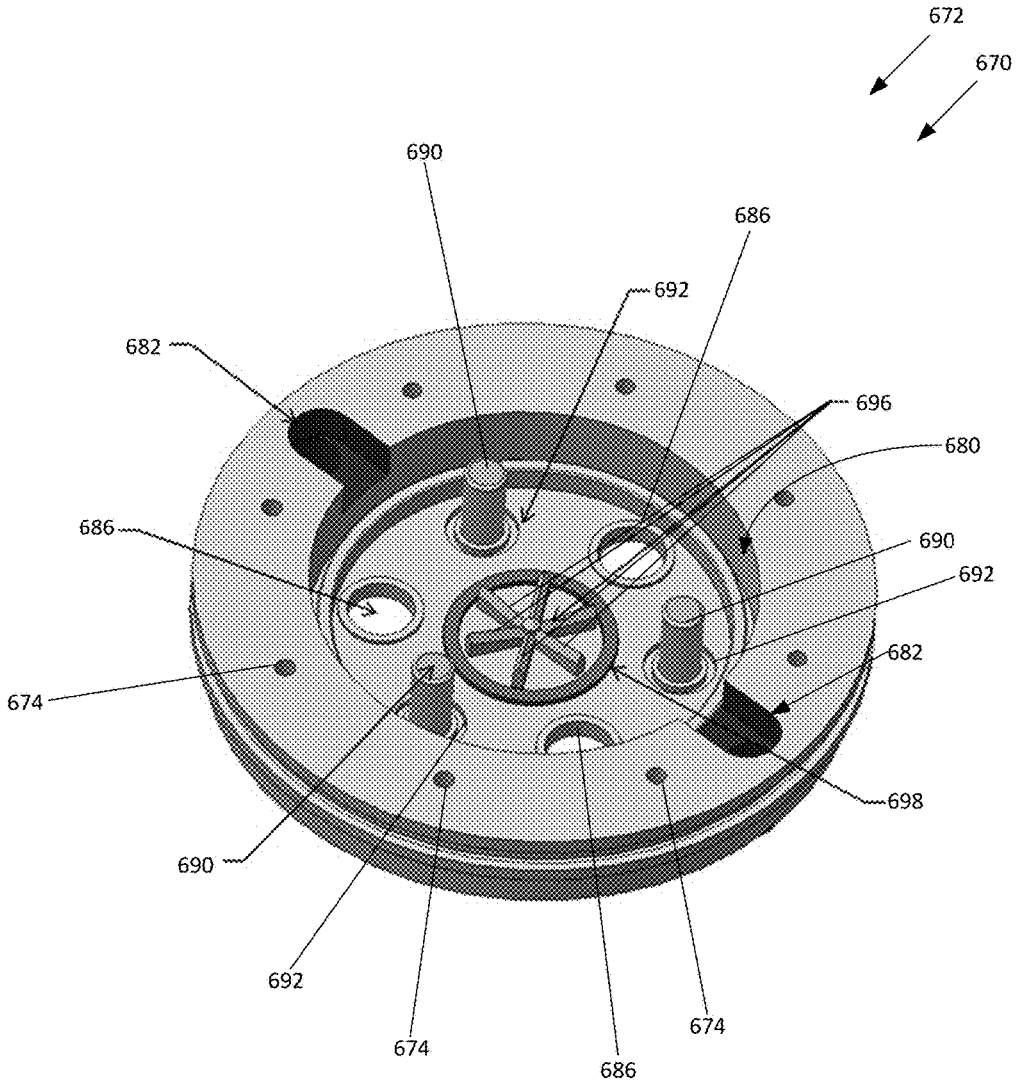
FIG. 15 illustrates a perspective view of a base portion of the second embodiment of the pneumatic air diverter valve illustrated in FIG. 12.

The base 670, as illustrated in FIGS. 14 and 15, includes a top side 672, a bottom side 676, and a sidewall 678 spanning between the top side 672 and the bottom side 676. The base 670 of the burst disc mechanism 600 is substantially similar to the rotary disc mechanism 400. As illustrated in FIG. 13, the bottom side 676 of the base 670 serves as the bottom side 604 of the burst disc mechanism 600. Furthermore, the sidewall 678 of the base 600 serves primarily as the sidewall 606 of the burst disc mechanism 600. Returning to FIG. 15, centrally disposed within the top side 672 of the base 670 is a central cavity 680. Furthermore, also disposed within the top side 672 of the base 670 is a plurality of apertures 674, where the apertures 674 are oriented annularly around the central cavity 680. As further explained below, the annular apertures 674 are configured to at least partially receive the fastener 617 of the top cover 610.

FIG. 15 further illustrates that a pair of outer openings 682 are disposed in the top side 672 of the base 670 such that the outer openings 682 are in fluid communication with the central cavity 680. As best illustrated in FIGS. 13 and 15, the outer openings 682 extend through the base 670 from the top side 672 to the bottom side 676. FIG. 13 illustrates that each of the outer openings 682 includes a boss or flange 684 that extends from the bottom side 676 of the base 670 proximate to, and disposed around, the outer openings 682. When the bottom surface 676 of the base 670 of the burst disc mechanism 600 is in abutment with the second end 254 of the second adapter member 250, the bosses 684 of the outer openings 682 are configured to be at least partially disposed within the proximal ends 266(1), 266(2) of the channels 262(1), 262(2) such that the outer openings 682 of the base 670 are in fluid communication with the channels 262(1), 262(2) of the second adapter member 250. Thus, the bosses 684 are configured to align the base 670, and as a result, the burst disc mechanism 600, with the second adapter member 250 such that the outer openings 682 are in fluid communication with the channels 262(1), 262(2) of the second adapter member 250. In addition, the bosses 684 are also configured to form a seal between the channels 262(1), 262(2) of the second adapter member 250 and the outer openings 682 such that, as air received by the burst disc mechanism 600 is diverted through the outer openings 682 and into the channels 262(1), 262(2) of the second adapter member 250, air does not escape between the burst disc mechanism 600 and the second adapter member 250.

As best illustrated in FIG. 15, disposed within the central cavity 680 of the base 670 are a series of inner openings 686. In the embodiment illustrated in FIGS. 14 and 15, the central cavity 680 of the base 670 includes three inner openings 686 that extend through the central cavity 680 to the bottom side 676 of the base 670. Like the rotary disc mechanism 400, when the bottom surface 676 of the base 670 of the burst disc mechanism 600 is in abutment with the second end 254 of the second adapter member 250, the inner openings 676 are aligned with the central passage 258 of the second adapter member 250 such that the inner openings 686 are in fluid communication with the central passage 258. The inner openings 686 are equally spaced around the periphery of the central cavity 680, where the inner openings 686 are offset from one another by approximately 120 degrees around the periphery of the central cavity 680.

Also disposed within the central cavity 680 of the base 670 is a series of piston guide pins 690. In the embodiment illustrated in FIGS. 14 and 15, the central cavity 680 of the base 670 includes three guide pins 690 that extend upwardly through the central cavity 680 toward the top side 672 of the base 670. Like the inner openings 686, the guide pins 690 are equally spaced around the periphery of the central cavity 680 where the guide pins 690 are offset from one another by approximately 120 degrees around the periphery of the central cavity 680. As further illustrated, each guide pin 690 is disposed between two inner openings 686 along the periphery of the central cavity 680 such that the guide pins 690 and the inner openings 686 are oriented in an alternating fashion around the periphery of the central cavity 680. Disposed around the base (i.e., the coupling of the guide pins 690 to the central cavity 680) of each guide pin 690 is a groove or depression 692. Furthermore, as best illustrated in FIG. 14, a resilient member or spring 694 is disposed around each of the guide pins 690. Each resilient member 694 is positioned around its respective guide pin 690 and at least partially disposed within the groove 692. Thus, grooves 692 retain each resilient member 694 in position around the guide pins 690.

Continuing with FIG. 15, the central cavity 680 of the base 670 also includes a plurality of protrusions or punch blades 696 disposed centrally within the central cavity 680. In the embodiment illustrated in FIG. 15, the central cavity 680 includes six radial protrusions 696 that are coupled to one another in a star-like formation. Other embodiments of the base 670 may contain any number of protrusions 696, and the protrusions may be oriented within the central cavity 680 of the base 670 in any shape or orientation. Furthermore, the protrusions 696 are centrally disposed inward from the guide pins 690 and the inner openings 686. The protrusions 696 extend upwardly through the central cavity 680 toward the top side 672 of the base 670. FIG. 15 further illustrates a seal or gasket ring 698 centrally disposed within the central cavity 680, and around the protrusions 696. Moreover, the gasket ring 698 is also disposed radially inward from the guide pins 690 and the inner openings 686 (i.e., the gasket ring 698 is more centrally disposed than the guide pins 690 and the inner openings 686.

Turning to FIG. 14, illustrated is the piston 640 of the burst disc mechanism 600. As best illustrated in FIG. 14, the piston 640 is configured to be slidably disposed within the central cavity 680 of the base 670. Thus, the piston 640 is approximately the same diameter as that of the central cavity 680. However, as will be further detailed below, the height or thickness of the piston 640 is less than that of the height or depth of the central cavity 680 of the base 670. The piston 640 is substantially disc-shaped with a top side 642 and a bottom side 648. Similar to the piston 460 of the rotary disc mechanism 400, disposed centrally within the top side 642 of the piston 640 is a cavity 650. Also disposed in the top side 642 of the piston 640 is a plurality of openings 646, where the openings 646 are oriented annularly around the cavity 650. The annular openings 646 extend through the piston 640 from the top side 642 to the bottom side 648. The annular openings 646 are configured to slidably receive the piston guide pins 690 of the base 670. Thus, the piston 640 slides along the piston guide pins 690 of the base 670 (i.e., the guide pins 690 slide through the annular openings 646) when the piston 640 moves up and down through the central cavity 680 of the base 670.

As best illustrated in FIG. 14, the cavity 650 of the piston 640 is substantially circular and includes a central opening 652 and three L-shaped locking grooves 654 extending outward from the circular profile of the sidewall of the cavity 650. The central opening 652 is concentrically centered within the cavity 650 of the piston 640 and extends through the cavity 650 to the bottom side 648 of the piston 640. In addition, the L-shaped grooves 654 are equally spaced around the periphery of the cavity 650 such that the grooves 654 are offset from one another by approximately 120 degrees around the periphery of the cavity 650. The L-shaped grooves 654 contain an upper, vertical section and a lower, horizontal section. The upper vertical section of each groove 654 is open to the top surface of piston 640 and is configured to receive a flange inserted from the top surface. The upper vertical section of each groove has a horizontal cross section that corresponds to the horizontal cross-sectional shape of the flange such that the flange can travel from the top to the bottom of the groove when inserted vertically. The lower horizontal section of each groove 654 has a larger horizontal cross section than the upper vertical section and a vertical height sufficient to receive the flange. The lower horizontal section of each groove 654 is configured to receive a flange traveling through the bottom of the upper vertical section such that horizontal rotation of the flange causes it to lodge in the horizontal section of groove 654 to lock the flange in place.

Continuing with FIG. 14, the burst disc mechanism 600 further includes a burst disc 630 that is configured to be disposed within the cavity 650 of the piston 640. As illustrated, the burst disc 650 is substantially disc-shaped with a top side 632 and a bottom side 634. The burst disc 630 may have a diameter that is substantially equal to the diameter of the cavity 650 of the piston 640, and at least larger than the diameter of the central opening 652. The burst disc 630 contains an inner portion 636 and an outer or border portion 638. The inner portion 636 may be constructed from, but is not limited to, a biaxially-oriented polyethylene terephthalate film. The outer portion 638 may be constructed from, but is not limited to, aluminum.

As further illustrated in FIG. 14, a retainer disc 620 is disposed within the cavity 650 of the piston 640 to retain the burst disc 630 within the cavity 650 of the piston 640. As illustrated, the retainer disc 620 of the burst disc mechanism 600 is approximately the same diameter as that of the cavity 650 of the piston 640 such that the retainer disc 620 is configured to fit within cavity 650 of the piston 640. The retainer disc 620 is substantially disc-shaped with a top side 622, a bottom side 624, and a sidewall 623 spanning between the top side 622 and the bottom side 624. The retainer disc 620 further includes a centrally disposed opening 625 that extends through the retainer disc 620 from the top side 622 to the bottom side 624. As further illustrated in FIG. 14, extending outwardly from the sidewall 623 of the retainer disc 620 proximate to the bottom side 624 are a plurality of flanges 626. The flanges 626 are offset from one another approximately 120 degrees around the sidewall 623 of the retainer disc 620. Furthermore, the flanges 626 are substantially equivalent in width to that of the grooves 654 of the cavity 650 of the piston 640, such that, when the retainer disc 620 is inserted into the cavity 650 of the piston 640, the flanges 626 are inserted through the vertical section of the grooves 654. Once inserted into the cavity 650 of the piston 640 so that the bottom surface 624 of the retainer disc 620 abuts the top surface 632 of the burst disc 630 as the bottom surface 634 of the burst disc 630 abuts the bottom of the cavity 650 of the piston 640, the retainer disc 620 may be rotated such that the flanges 626 slide into the horizontal sections of the grooves 654 of the cavity 650 of the piston 640 to lock the retainer disc 620, and ultimately the burst disc 630, into the cavity 650 of the piston 640. FIG. 14 further illustrates that the top side 622 includes a pair of cross-members 628 that extend across the top side 622 and the central opening 625, where the cross-members 628 intersect one another to form an X-shape on the top side 622 of the retainer disc 620.

In addition, FIG. 14 also illustrates a top cover 610 that is configured to be disposed on, and coupled to, the base 670. The top cover 610 is disc-shaped with a top side 612 and a bottom side 614. As illustrated, the top cover 610 includes a central opening 618 that extends through the top cover 610 from the top side 612 to the bottom side 614. The central opening 618 of the top cover 610 contains a diameter that is slightly smaller than the diameter of the central cavity 610 of the base 670 and the diameter of the piston 640. When the bottom side 614 of the top cover 610 is disposed on the top side 672 of the base 670, the bottom side 614 of the top cover 610 at least partially covers the top side 642 of the piston 640.

The top cover 610 also includes a series of apertures 616 that are oriented annularly around the central opening 618 of the top cover 610. The annular apertures 616 of the top cover 610 are configured to align with the annular apertures 674 disposed on the top side 672 of the base 670. Thus, when the bottom side 614 of the top cover 610 is disposed on the top side 672 of the base 670, fasteners 617 (e.g., screws, pins, bolts, etc.) may be inserted through the annular apertures 616 of the top cover 610 and at least partially into the annular apertures 674 of the base 670 to secure the top cover 610 to the base 670. When the top cover 610 is secured to the base 670, the piston 640, burst disc 630, and retainer disc 620 are secured to the base 670 with the capability of sliding through the central cavity 680 of the base 670.

Returning to FIG. 12, the top side 602 of the burst disc mechanism 600 is collectively formed from the top side 612 of the top cover 610, the top side 642 of the piston 640, the ends of the guide pins 690, and the retainer disc 620. As illustrated, the burst disc 630 is visible through the central opening 625 of the retainer disc 620, while the ends of the guide pins 690 are visible through the annular openings 646 of the piston 640. In addition, the retainer disc 620, burst disc 630, piston 640, and guide pins 690 are visible through the central opening 618 of the top cover 610.

Turning to FIG. 16, illustrated is the burst disc mechanism 600 disposed within the cavity 132 of the SLC 100 proximate to the second end 120 of the SLC 100, where the SLC 100 is illustrated with a cutaway portion that is for illustrative purposes only. When disposed within the cavity 132, the O-ring 608 of the burst disc mechanism 600 forms a seal along the inner surface of the sidewall 130 that forms the cavity 132. Moreover, the retainer disc 620 is disposed proximate to, and in fluid communication with, the aperture 122 of the second end 120 of the SLC 100 such that air is capable of traveling through the apertures 122 of the second end 120 of the SLC 100 and into the burst disc mechanism 600 via the central opening 625 of the retainer disc 620 and the piston 640.

Figure 17A:
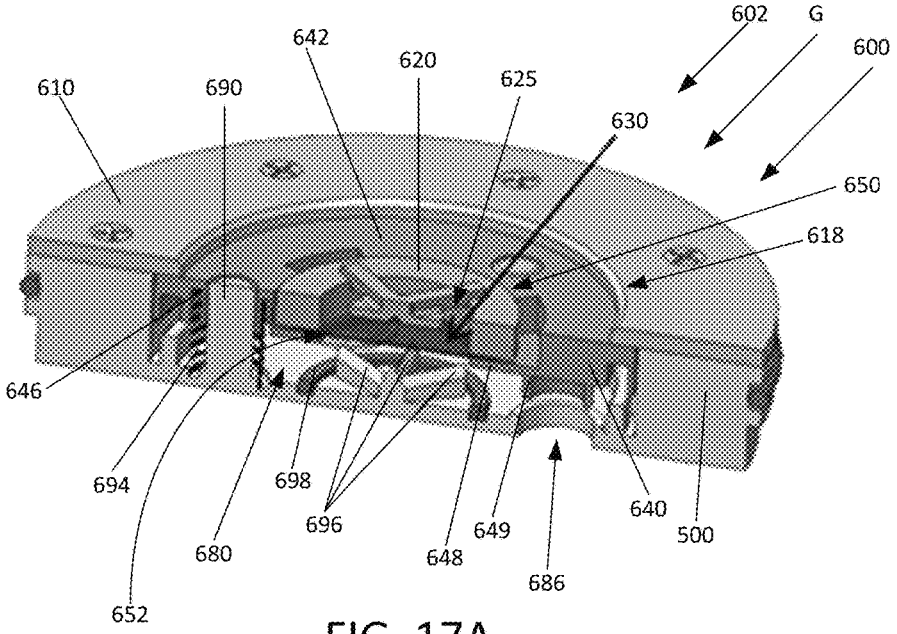
FIGS. 17A-17F illustrate cross-sectional view of the operational stages of the second embodiment of the pneumatic air diverter valve illustrated in FIG. 12.

FIGS. 17A-17F illustrate the cross-sectional views of the operation and various positions of the components of the burst disc mechanism 600 during the various stages of launching two miniature sonobuoys 300(1), 300(2), as illustrated in FIGS. 3A-3D. As illustrated in FIG. 17A, the burst disc mechanism 600 is oriented in static position G, which occurs prior to the burst disc mechanism 600 receiving a first burst of air from the pneumatic launching mechanism. As illustrated in FIG. 17A, the resilient members 694 disposed around the guide pins 690 bias the piston 640 towards an upward position within the central cavity 680 of the base 670, where the top side 642 of the piston 640 is in abutment with the top cover 610. Moreover, in this first static position G, the burst disc 630 forms a seal across the central opening 652 of the cavity 650 of the piston 640, where the burst disc 630 is retained in the cavity 650 by the retainer disc 620. As previously explained, the retainer disc 620 may be inserted into the cavity 650 of the piston 640, where the flanges 626 on the sidewall 623 of the retainer disc 620 align with the grooves 654 of the cavity 650 of the piston 640. Once fully inserted into the cavity 650 of the piston 640, the retainer disc 620 may be rotated within the cavity 650 of the piston 640 so that the flanges 626 slide into the horizontal sections of the grooves 654, which locks the retainer disc 620 into the cavity 650 of the piston 640. This secures the burst disc 630 in the cavity 650 of the piston 640 between the bottom side 624 of the retainer disc 620 and the base of the cavity 650 of the piston 640 (i.e., the burst disc 630 forms a seal over the central opening 652 of the cavity 650 of the piston 640).

Figure 17B:
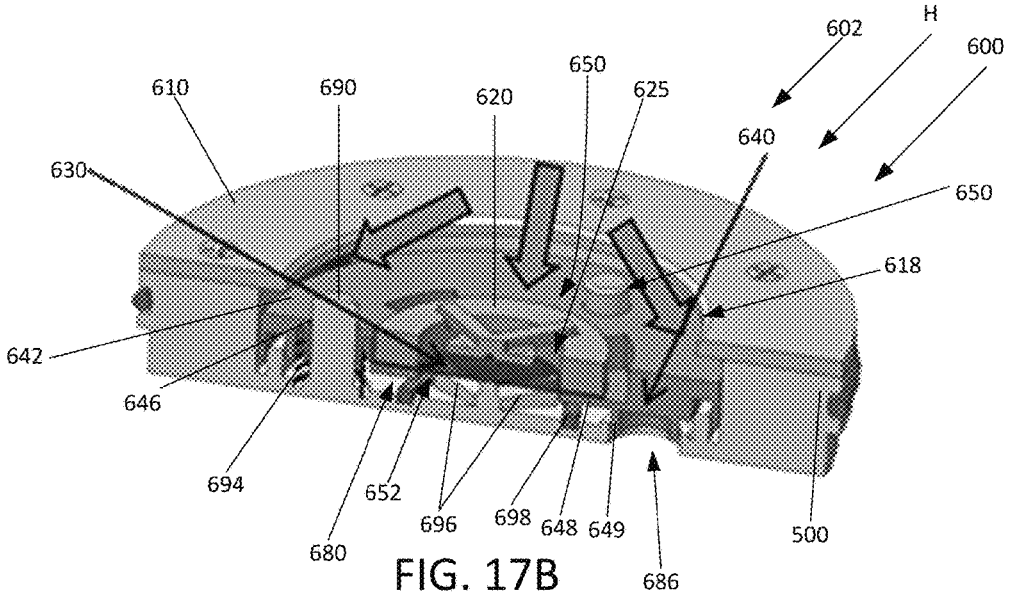
Figure 17C:
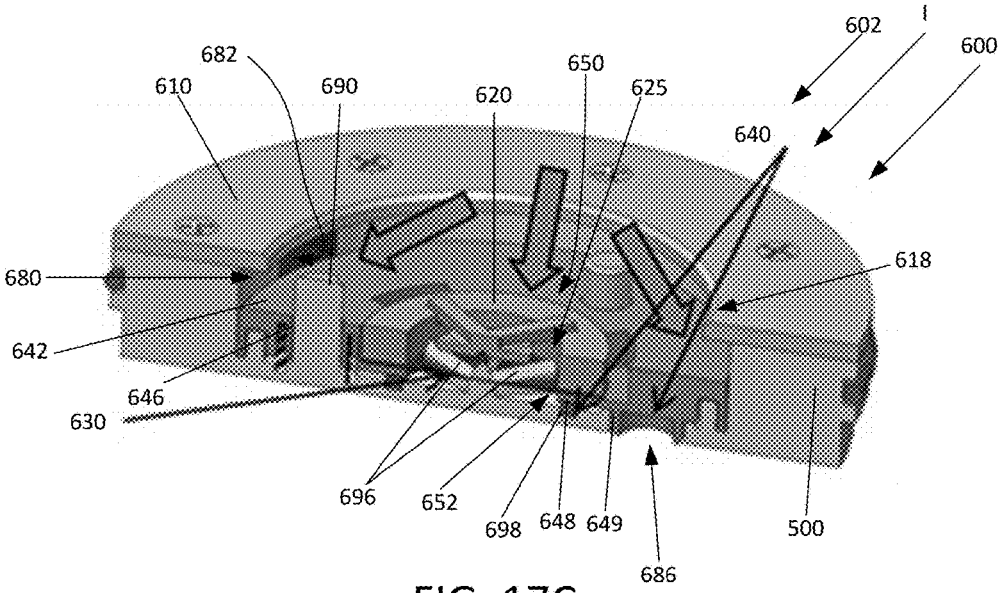

As illustrated in FIGS. 17B and 17C, when air is forced onto the top side 602 of the burst disc mechanism 600 (i.e., air impacts the top side 602 of the burst disc mechanism 600), the force of the air causes the piston 640 to slide downwardly through the central cavity 680 of the base 670 such that the bottom side 648 of the piston 640 moves toward the surface of the central cavity 680 of the base 670. FIG. 17B illustrates the position H of the piston 640, where the piston 640 has traveled along the central cavity 680 of the base 670 approximately 50% of the possible travel distance, while FIG. 17C illustrates the position I of the piston 640, where the piston 640 has traveled along the central cavity 680 of the base 670 approximately 100% of the possible travel distance. Because the burst disc mechanism 600 forms a seal within the cavity 132 of the SLC 100, and because the burst disc 630 forms a seal over the central opening 652 of the piston 640, the air is able to force movement of the piston 640 along the guide pins 690 of the central cavity 680 of the base 670.

As illustrated, the bottom surface 648 of the piston 640 includes a series of bosses 649 that extend downwardly from the bottom surface 648. The bosses 649 of the piston 640 are aligned with the inner openings 686 of the central cavity 680 of the base 670. Thus, as the piston 640 moves from position G to position H, the bosses 649 slide into the inner openings 686 of the central cavity 680 of the base 670 to form a seal with the inner openings 686. Furthermore, as the piston 640 moves from position G to position H, the top side 642 of the piston 640 moves away from the top cover 610, such that the top side 642 of the piston 640 moves downwardly past the outer openings 682. Once the outer openings 682 are exposed, the air being imparted onto the top side 602 of the burst disc mechanism 600 travels through the outer openings 682, and into the channels 262(1), 262(2) of the second adapter member 250 to launch the first miniature sonobuoy 300(1) from the first adapter member 210, as previously explained.

FIG. 17C further illustrates that, when the burst disc mechanism 600 is in position I, the bottom surface 648 of the piston 640 is in contact with the gasket ring 698. In addition, when in position I, the protrusions 696 of the central cavity 680 of the base 670 are forced through the burst disc 630 (i.e., the protrusions 696 of the central cavity 680 of the base 670 punch through or puncture the burst disc 630). More specifically, when the burst disc mechanism 600 is in position I, the protrusions 696 of the central cavity 680 of the base 670 extend upwardly through the central opening 652 of the piston 640 such that the protrusions puncture the burst disc 630 disposed within the cavity 650 of the piston 640. This causes the burst disc 630 to no longer form a seal over the central opening 652 of the cavity 650 of the piston 640. In other words, the first burst of air causes the burst disc 630 to rupture, creating a central air passage through central opening 652, but the first burst of air does not flow through the central opening 652 due to the position of the piston 640 and the engagement of the bosses 649 and the inner openings 686 of the central cavity 680 of the base 670.

Figure 17D:
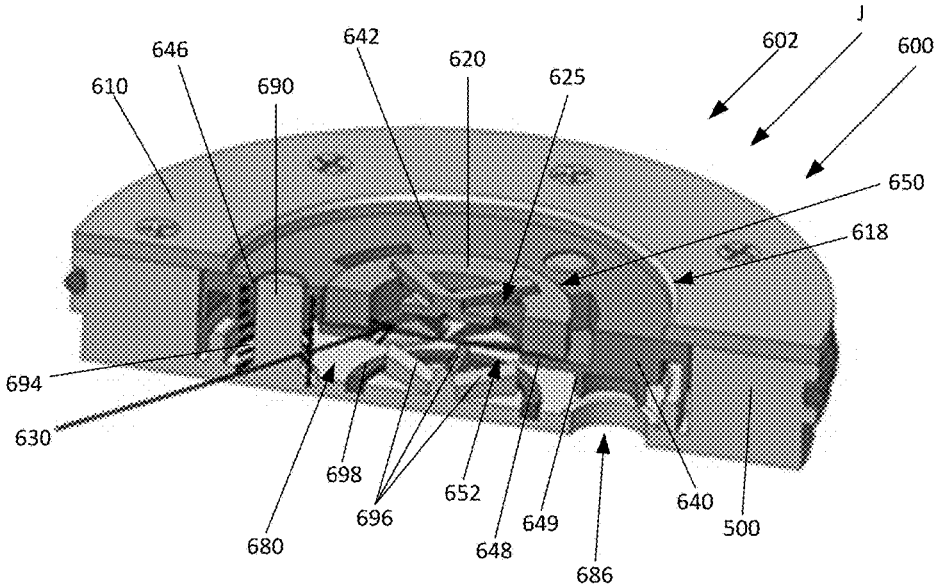

As illustrated in FIG. 17D, once the flow of air from the first burst of air has ended, the burst disc mechanism 600 is oriented in position J, where the resilient members 694 have returned the piston 640 to the top position within the central cavity 680 of the base 670 so that the top side 642 of the piston 640 is in abutment with the top cover 610. Moreover, in position J, the bottom surface 648 of the piston 640 is spaced from the gasket ring 698, and the bosses 649 are no longer disposed within the inner openings 686 of the central cavity 680 of the base 670. However, unlike position G, where the burst disc 630 is not punctured and forms a seal over the central opening 652 of the piston 640, when in position J, the burst disc 630 is punctured and no longer forms a seal over the central opening 652 of the piston 640.

Figure 17E:
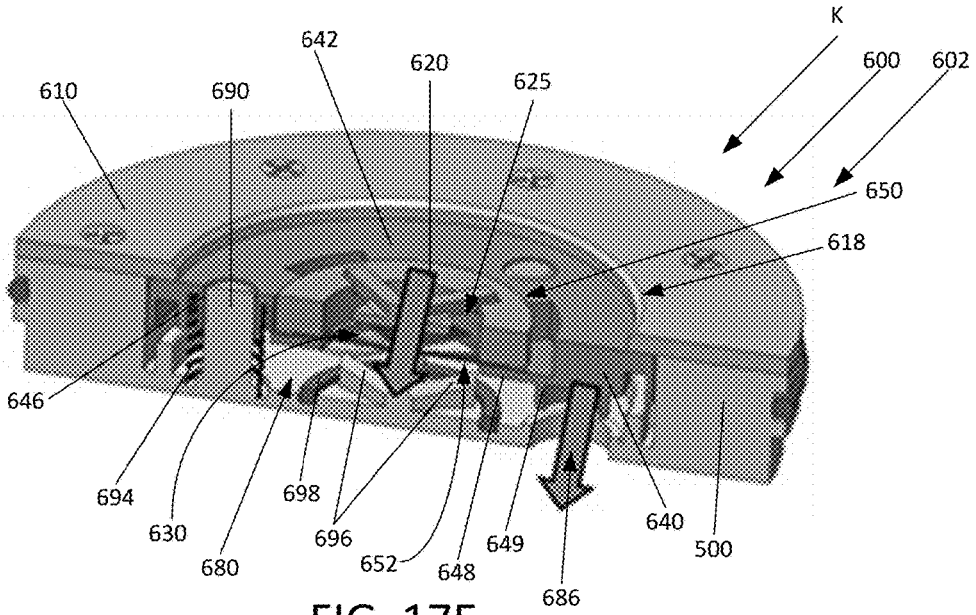

Thus, as illustrated in FIG. 17E, when the second burst of air from the pneumatic launching mechanism imparts air onto the top side 602 of the burst disc mechanism 600, the air is capable of flowing through the opening 625 of the retainer disc 620 and through the central opening 652 of the cavity 650 of the piston 640 because of the punctured openings in the burst disc 630. The air is free to flow through the opening 625 of the retainer disc 620, the punctured openings in the burst disc 630, the central opening 652 of the cavity 650 of the piston 640, and into the central cavity 680 of the base 670, where the air exits the burst disc mechanism 600 via the inner openings 686 of the central cavity 680 of the base 670. As previously explained, when the air flows through the inner openings 686 of the central cavity 680 of the base 670, the air flows into the central passage 258 of the second adapter member 250 to launch the second miniature sonobuoy 300(2) from the second adapter member 250.

Figure 17F:
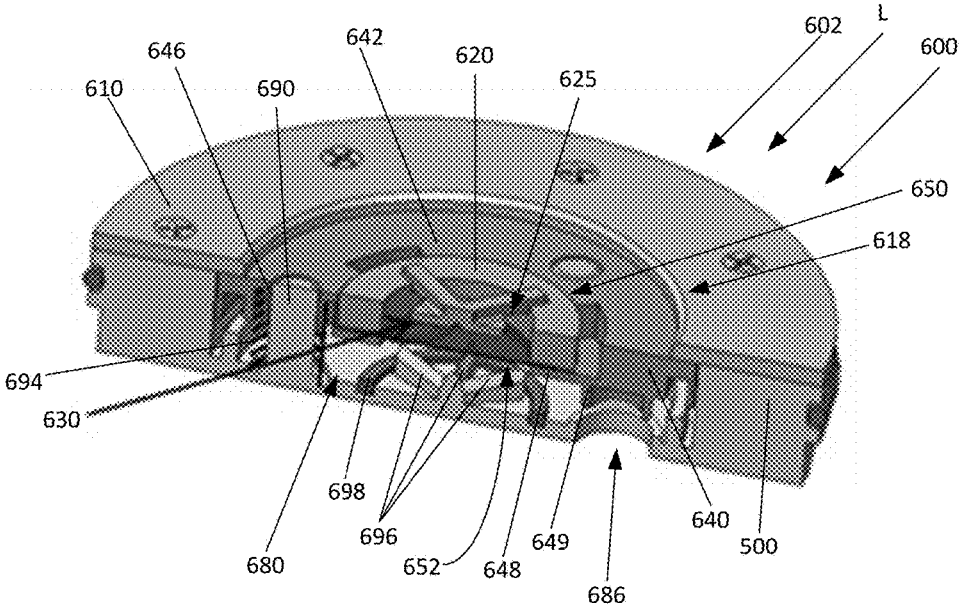

As illustrated in FIG. 17F, after the flow of air from the second burst of air has ended, the punctured burst disc 630 may be replaced by a new non-punctured burst disc 630. To replace the punctured burst disc 630, the retainer disc 620 is rotated within the cavity 650 of the piston 640 until the flanges 626 are aligned with the vertical sections of the grooves 654 of the cavity 650 of the piston 640. The retainer disc 620 may then be pulled out of the cavity 650 of the piston 640 to facilitate removal of the punctured burst disc 630 and insertion of a new non-punctured burst disc 630. Once the new burst disc 630 is inserted into the cavity 650 of the piston 640, the retainer disc 620 may be inserted into the cavity 650 of the piston 640. As previously explained, once fully inserted into the cavity 650 of the piston 640, the retainer disc 620 may be rotated within the cavity 650 of the piston 640 so that the flanges 626 slide into the horizontal sections of the grooves 654, which locks the retainer disc 620 into the cavity 650 of the piston 640 and secures the new burst disc 630 in the cavity 650 of the piston 640. Thus, the burst disc mechanism 400 can be reconfigured to subsequently launch two more miniature sonobuoys 300(1), 300 (2) once they are loaded within the SLC 100 by simply exchanging the punctured burst disc 630 for a new burst disc 630.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An adapter for launching miniature sonobuoys from a sonobuoy launching container comprising:

a first cylindrical member disposed within the sonobuoy launching container, the first cylindrical member comprising:

a first end, a second end, and a first central passage extending from the second end to the first end;

a second cylindrical member disposed within the sonobuoy launching container in line with the first cylindrical member, the second cylindrical member comprising:

a third end, a fourth end, a sidewall extending from the fourth end to the third end, at least one channel disposed within the sidewall, and a second central passage extending from the fourth end to the third end, wherein the third end of the second cylindrical member is in abutment with the second end of the first cylindrical member and the first central passage is in fluid communication with the second central passage; and a diverter mechanism disposed within the sonobuoy launching container in line with the first cylindrical member and the second cylindrical member, the diverter mechanism configured to automatically divert a first burst of air along the at least one channel of the second cylindrical member and automatically divert a subsequent second burst of air along the second central passage of the second cylindrical member.

2. The adapter according to claim 1, wherein the first central passage of the first cylindrical member is sized to receive a first miniature sonobuoy.

3. The adapter according to claim 2, wherein the first cylindrical member further comprises:

a first endcap disposed in the first central passage proximate to the first end; and a first piston disposed in the first central passage proximate to the second end, wherein the first miniature sonobuoy is retained in the first central passage between the first endcap and the first piston.

4. The adapter according to claim 3, wherein the first endcap further comprises:

shear clips that interact with the first end of the first central passage to retain the first miniature sonobuoy within the first central passage of the first cylindrical member until the adapter receives the first burst of air.

5. The adapter according to claim 3, wherein the second central passage of the second cylindrical member is sized to receive a second miniature sonobuoy.

6. The adapter according to claim 5, wherein the second cylindrical member further comprises:

a second endcap disposed in the second central passage proximate to the third end; and a second piston disposed in the second central passage proximate to the fourth end, wherein the second miniature sonobuoy is retained in the second central passage between the second endcap and the second piston.

7. The adapter according to claim 6, wherein the second endcap further comprises:

shear clips that interact with the third end of the second central passage to retain the second miniature sonobuoy within the second central passage of the second cylindrical member until the adapter receives the second burst of air.

8. The adapter according to claim 6, wherein the at least one channel further comprises:

an inlet in fluid communication with the diverter mechanism; and an outlet disposed between the first piston of the first cylindrical member and the second endcap of the second cylindrical member.

9. The adapter according to claim 8, wherein the first burst of air is configured to launch the first miniature sonobuoy from the first central passage of the first cylindrical member and the sonobuoy launching container.

10. The adapter according to claim 8, wherein the second burst of air is configured to launch the second miniature sonobuoy from the second central passage of the second cylindrical member, through the first central passage of the first cylindrical member, and from the sonobuoy launching container.

11. The adapter of claim 1, wherein the diverter mechanism is a pneumatic diverter mechanism, the pneumatic diverter mechanism comprising:

a base with a top side, a bottom side, and a central cavity disposed within the top side, the base comprising:

at least one inner opening disposed within the central cavity and extending through the bottom side of the base, and at least one outer opening disposed in the base and in fluid communication with the central cavity, the at least one outer opening extending through the bottom side of the base;

a piston having a top side and a bottom side, the piston being slidably disposed within the central cavity of the base between a first position, where the piston covers the at least one outer opening and the bottom side of the piston is spaced from the at least one inner opening, and a second position, where the at least one outer opening is exposed and the bottom side of the piston is disposed proximate to the at least one inner opening, the piston comprising:

a circular cavity concentrically disposed within the top side of the piston, and at least one air port disposed within the circular cavity and extending through the bottom side of the piston; and a rotary disc rotatably disposed within the central cavity of the piston, the rotary disc including at least one aperture and being rotatable between a locked position, where the at least one aperture is not aligned with the at least one air port of the piston, and an unlocked position, where the at least one aperture is aligned with the at least one air port of the piston, and wherein, when the rotary disc is in the locked position and the pneumatic diverter mechanism receives the first burst of air, the piston is reconfigured from the first position to the second position causing the first burst of air to be diverted through the at least one outer opening and causing the rotary disc to automatically rotate to the unlocked position, and when the rotary disc is in the unlocked position and the pneumatic diverter mechanism receives the second burst of air, the second burst of air is diverted through the at least one air port of the piston and the at least one inner opening of the base.

12. The adapter of claim 11, wherein the circular cavity of the piston further comprises:

at least one slot that extends through the bottom side of the piston.

13. The adapter of claim 12, wherein the rotary disc further comprises:

at least one tab disposed on a bottom surface of the rotary disc, the at least one tab being disposed within the at least one slot of the circular cavity of the piston when the rotary disc is in the locked position.

14. The adapter of claim 13, wherein the central cavity of the base further comprises:

at least one projection that extends upward through the central cavity of the base, the at least one projection extending through the at least one slot of the circular cavity of the piston when the piston is in the second position; and at least one resilient member that biases the piston to the first position.

15. The adapter of claim 14, wherein the pneumatic diverter mechanism further comprises:

a torsional spring disposed within the circular cavity of the piston and around the rotary disc, the torsional spring interacting with the circular cavity of the piston and the rotary disc to bias the rotary disc to the unlocked position.

16. The adapter of claim 1, wherein the diverter mechanism is a pneumatic diverter mechanism, the pneumatic diverter mechanism comprising:

a base with a top side, a bottom side, and a central cavity disposed within the top side, the base comprising:

at least one inner opening disposed within the central cavity and extending through the bottom side of the base, at least one outer opening disposed in the base and in fluid communication with the central cavity, the at least one outer opening extending through the bottom side of the base, and at least one projection that extends upward through the central cavity of the base;

a piston having a top side and a bottom side, the piston being slidably disposed within the central cavity of the base between a first position and a second position, the piston comprising:

a circular cavity concentrically disposed within the top side of the piston, and a central opening disposed within the circular cavity and extending through the bottom side of the piston, wherein, in the first position, the piston covers the at least one outer opening and the bottom side of the piston is spaced from the at least one inner opening and the at least one projection, and in the second position, the at least one outer opening is exposed, the bottom side of the piston is disposed proximate to the at least one inner opening, and the at least one projection extends through the central opening; and a burst disc disposed within the central cavity of the piston and forming a seal over the central opening of the piston, and wherein, when the pneumatic diverter mechanism receives the first burst of air, the piston is reconfigured from the first position to the second position causing the first burst of air to be diverted through the at least one outer opening and causing the at least one projection to puncture the burst disc, and when the pneumatic diverter mechanism receives the second burst of air, the second burst of air is diverted through the punctured burst disc and the at least one inner opening of the base.

17. The adapter of claim 16, wherein the burst disc is constructed from a biaxially-oriented polyethylene terephthalate film.

18. The adapter of claim 16, wherein the central cavity of the base further comprises:

at least one resilient member that biases the piston to the first position.

19. The adapter of claim 16, further comprising:

a retainer disc disposed within the circular cavity of the piston, the retainer disc securing the burst disc within the circular cavity of the piston.

20. The adapter of claim 19, wherein the retainer disc further comprises:

an aperture disposed through the retainer disc.

* * * * *